US009242699B2

(12) United States Patent
Keller

(10) Patent No.: US 9,242,699 B2
(45) Date of Patent: Jan. 26, 2016

(54) WATERCRAFT HULL WITH IMPROVED LIFT, PLANING SPEED RANGE, AND NEAR MAXIMUM EFFICIENCY

(71) Applicant: K2 Keller Consulting, LLC, Newburgh, NY (US)

(72) Inventor: John H Keller, Newburgh, NY (US)

(73) Assignee: K2 Keller Consulting, LLC, Newburgh ( * ) Notice: Subject to any disclaimer, the term of this patent is extended or adjusted under 35 U.S.C. 154(b) by 124 days.

(21) Appl. No.: 14/046,119

(22) Filed: Oct. 4, 2013

(65) Prior Publication Data

US 2014/0096710 A1 Apr. 10, 2014

Related U.S. Application Data

(60) Provisional application No. 61/710,960, filed on Oct. 8, 2012.

(51) Int. Cl.

| | |
|---|---|
| ***B63B 1/32*** | (2006.01) |
| ***B63B 1/26*** | (2006.01) |
| ***B63B 1/18*** | (2006.01) |
| ***B63B 1/20*** | (2006.01) |

(Continued)

(52) U.S. Cl.

CPC ... *B63B 1/26* (2013.01); *B63B 1/18* (2013.01); *B63B 1/20* (2013.01); *B63B 35/7906* (2013.01); *B63B 39/061* (2013.01); *B63B 2001/201* (2013.01); *B63B 2001/202* (2013.01)

(58) Field of Classification Search

CPC ..... B63B 1/20; B63B 2001/201; B63B 2001/202; B63B 1/16; B63B 1/18

USPC ..... 114/271, 288, 290, 291

See application file for complete search history.

(56) References Cited

U.S. PATENT DOCUMENTS

| | | | | |
|---|---|---|---|---|
| 1,618,995 | A | 3/1927 | Plum | |
| 1,794,898 | A * | 3/1931 | Hillmann | 114/290 |

(Continued)

FOREIGN PATENT DOCUMENTS

| | | |
|---|---|---|
| EP | 0 059 345 | 9/1982 |
| WO | 2010/033579 | 3/2010 |

(Continued)

OTHER PUBLICATIONS

"Hydrofoil Handbook vol. II, Hydrodynamic Characteristics of Components", OTS-US Department of Commerce, 1954.

(Continued)

*Primary Examiner* — S. Joseph Morano
*Assistant Examiner* — Andrew Polay
(74) *Attorney, Agent, or Firm* — Whitham, Curtis, Christofferson & Cook PC; Timothy Miller; Marshall Curtis

(57) ABSTRACT

A hull for a planing type watercraft has a front lift surface, a high lift surface, and a back planing surface. The high lift surface is adjacent a rockered keel area and between the front lift surface and the back planing surface. The center of dynamic lift on the high lift surface is at or in front of a point which is 15% of the hull length behind a total center of gravity of the hull under loading. At least the back one third of the high lift surface is cambered, and a beam of the high lift surface is greater than two thirds of the maximum width of the hull. The average camber of the front lift surface, the high lift surface, and the back planing surface together is less than or equal to zero.

22 Claims, 14 Drawing Sheets

(51) Int. Cl.

| | |
|---|---|
| ***B63B 39/06*** | (2006.01) |
| ***B63B 35/79*** | (2006.01) |

(56) References Cited

U.S. PATENT DOCUMENTS

| | | | | | |
|---|---|---|---|---|---|
| 3,111,695 | A | | 11/1963 | Kelly, Jr. | |
| 3,149,351 | A | | 9/1964 | Plum | |
| 3,274,966 | A | | 9/1966 | Rethorst | |
| 3,495,563 | A | | 2/1970 | Reischmann | |
| 3,709,179 | A | | 1/1973 | Payne | |
| 3,763,810 | A | | 10/1973 | Payne | |
| 3,802,370 | A | | 4/1974 | Collier | |
| 4,002,131 | A | | 1/1977 | Mangrum | |
| 4,083,320 | A | | 4/1978 | Yost | |
| 4,649,851 | A | | 3/1987 | April | |
| 4,748,929 | A | * | 6/1988 | Payne | 114/280 |
| 4,843,988 | A | | 7/1989 | Clement | |
| 4,915,048 | A | | 4/1990 | Stanford | |
| 4,924,742 | A | | 5/1990 | Numata et al. | |
| 5,456,202 | A | | 10/1995 | Schoell | |
| 5,582,123 | A | | 12/1996 | Rethorst | |
| 5,588,389 | A | * | 12/1996 | Carter, Jr. | 114/271 |
| 6,138,601 | A | * | 10/2000 | Anderson et al. | 114/285 |
| 6,138,602 | A | | 10/2000 | Cary | |
| 6,935,909 | B2 | | 8/2005 | Mann | |
| 7,793,604 | B2 | | 9/2010 | Keller | |
| 7,845,301 | B2 | * | 12/2010 | Loui et al. | 114/284 |
| 7,845,302 | B2 | | 12/2010 | Loui et al. | |
| 8,122,840 | B2 | | 2/2012 | Harper | |
| 2010/0000455 | A1 | | 1/2010 | Harper | |

FOREIGN PATENT DOCUMENTS

| | | |
|---|---|---|
| WO | 2010/115106 | 10/2010 |
| WO | 2011-117906 | 9/2011 |

OTHER PUBLICATIONS

D. Savitsky; "Hydrodynamic Design of Planing Hulls"; Marine Technology, vol. 1, No. 1, Oct. 1964, pp. 71-95.

E. P. Clement; "A Configuration for a Stepped Planing Boat Having Minimum Drag (Dynaplane Boat)"; International Hydrofoil Society, Nov. 11, 2005, entire design paper.

Johnson, Jr.; "Theoretical and Experimental Investigation of Supercavitating Hydrofoils Operating Near the Free Water Surface"; NASA Tech. Report R-93, 1961, pp. 1-78.

W. Sottorf, Experiments with Planing Surfaces, National Advisory Committee for Aeronautics, Technical Memorandum No. 739, Mar. 1934, p. 19-22.

Blount, D.L. and Codega, L.T., Dynamic Stability of Planing Boats. Marine Technology, vol. 29, No. 1, Jan. 1992, p. 4-12.

* cited by examiner

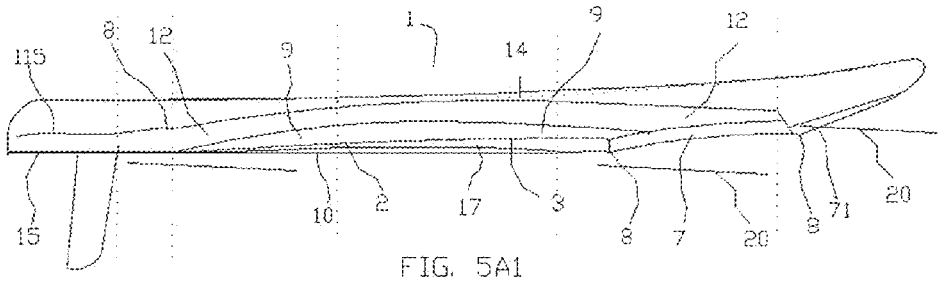
FIG. 5A1
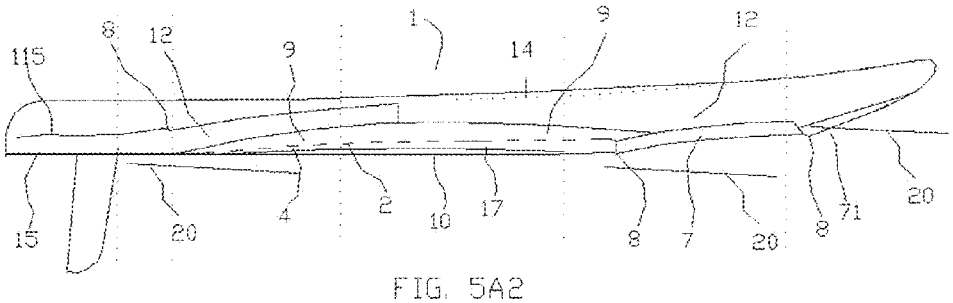
FIG. 5A2
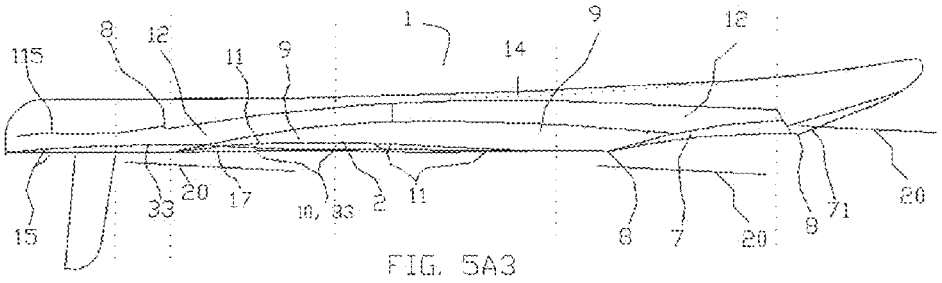
FIG. 5A3

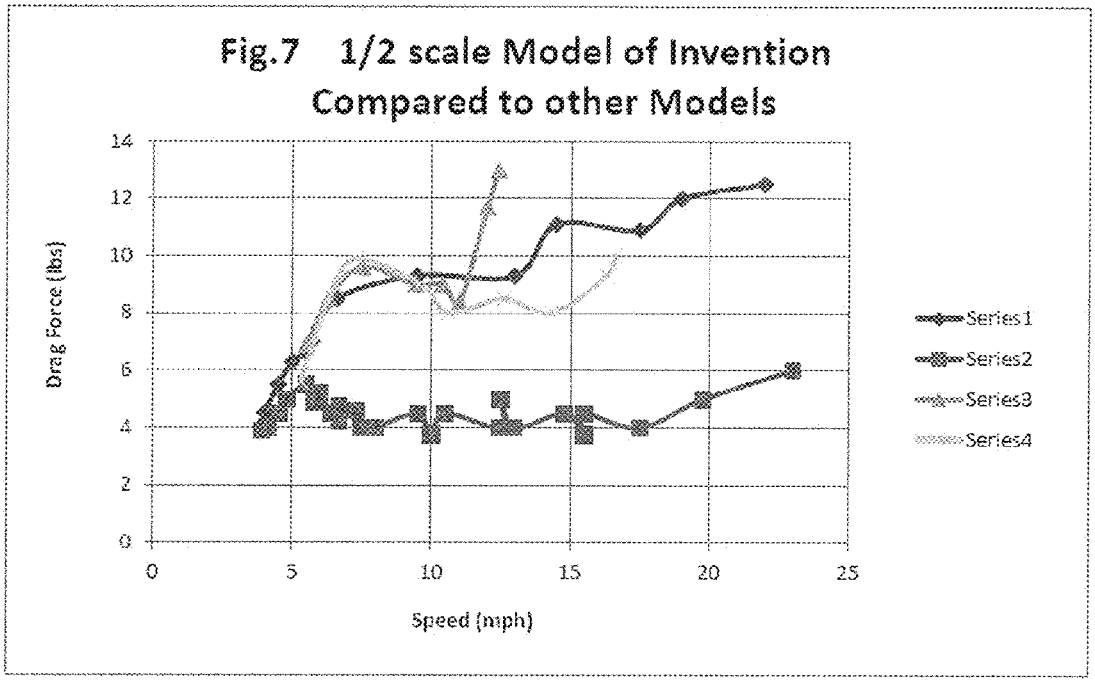
Fig.7 1/2 scale Model of Invention
Compared to other Models
Drag Force (lbs)
14
12
10
8
6
4
2
0
0
5
10
15
20
25
Speed (mph)
Series1
Series2
Series3
Series4

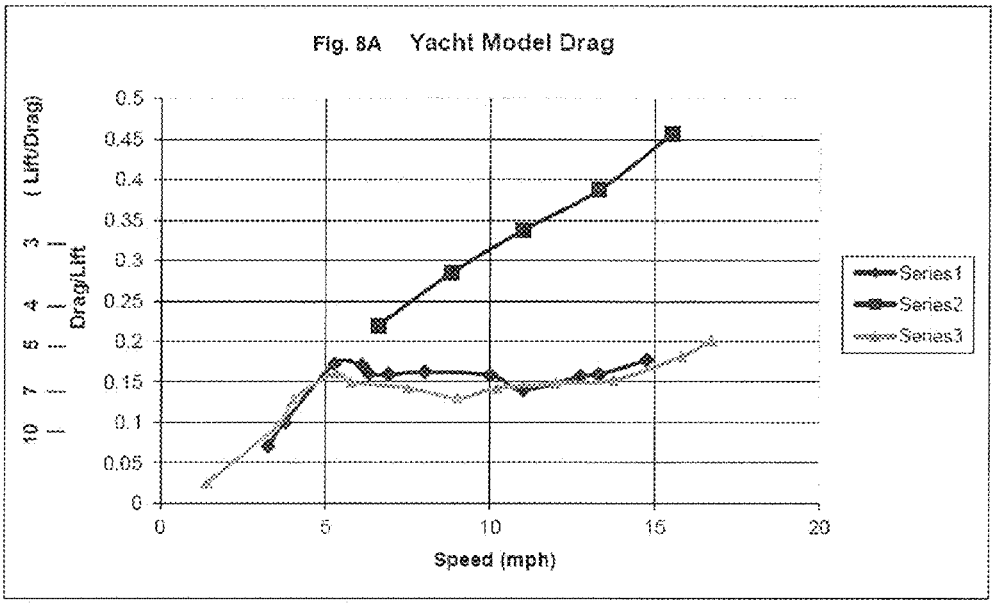
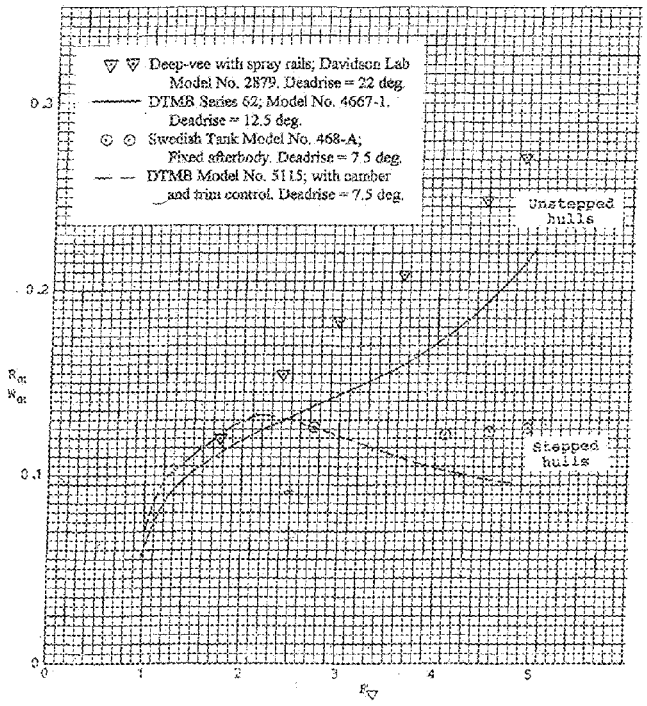
Figure 8B

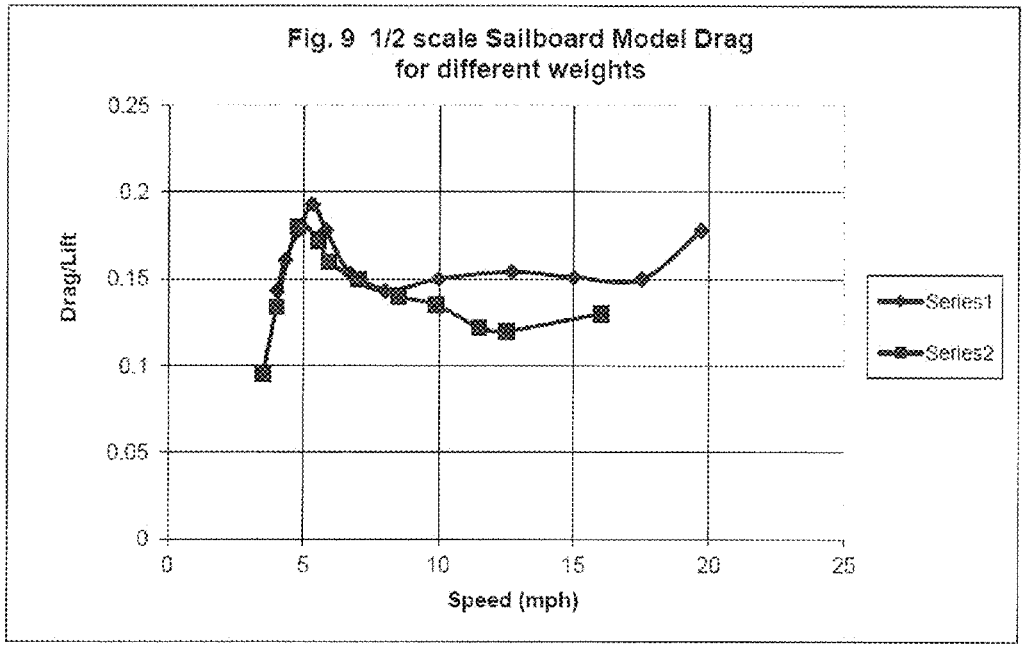
Fig. 9 1/2 scale Sailboard Model Drag
for different weights
0.25
0.2
0.15
0.1
0.05
0
Drag/Lift
0
5
10
15
20
25
Speed (mph)
Series1
Series2
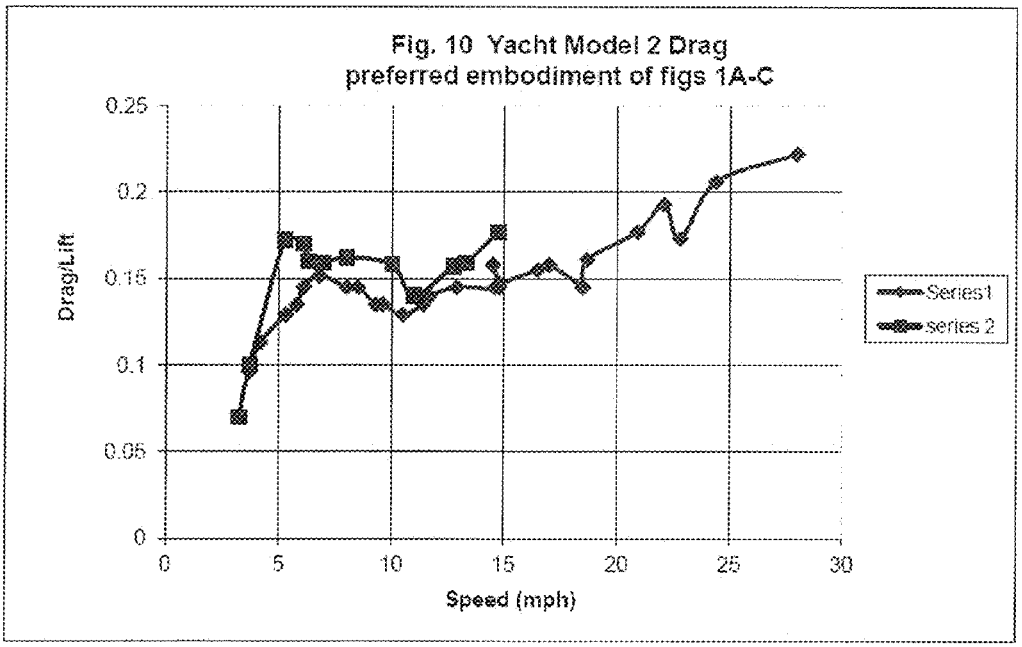
Fig. 10 Yacht Model 2 Drag
preferred embodiment of figs 1A-C
0.25
0.2
0.15
0.1
0.05
0
Drag/Lift
0
5
10
15
20
25
30
Speed (mph)
Series1
series 2

WATERCRAFT HULL WITH IMPROVED LIFT, PLANING SPEED RANGE, AND NEAR MAXIMUM EFFICIENCY

CROSS-REFERENCE TO RELATED APPLICATIONS

This application claims priority to U.S. provisional patent application No. 61/710,960 filed Oct. 8, 2012, which is hereby fully incorporated herein by reference.

FIELD OF THE INVENTION

The present invention generally relates to hull designs for watercraft capable of planing such as power boats (including speed boats and yachts), surfboards, sailboards, stand up paddle (SUP) boards, and kite and wake boards.

BACKGROUND

Many watercraft are designed to operate in a planing mode as well as in a displacement mode. In the planing mode of operation, lift is derived from a downward deflection of water by the shape of the hull. In the displacement mode of operation, which generally occurs at lower speeds as compared with planing mode, lift is derived from the weight of water displaced by the hull.

In transition between these modes there is often considerable wave and turbulence drag. This is often due to the conflict in the preferred watercraft design features for displacement mode operation, e.g. a slender/narrow hull, versus preferred features for planing mode operation, e.g. a flat planing bottom or a flat planing bottom with a dead rise angle. A planing bottom may be split in the transverse direction (as in a tunnel boat) or split in the longitudinal direction with displacement in the vertical direction at the split. For most hulls intended to be operable in a planing mode of operation, the bottom shape is generally flat in the longitudinal direction near the back or stern and has rocker toward the bow.

For a wing/deep hydrofoil, as given in the "HYDROFOIL HANDBOOK Vol. II, Hydrodynamics Characteristics of Components", OTS-US Dept of Commerce, Eq. 1.6, the two-dimensional lift coefficient, $C_L$, is given by:

$$C_L=2\pi(\alpha_o+2f/c), \quad (1)$$

where $\alpha_o$ is the attack angle, f is the maximum deviation of the mean camber line from the chord line which goes from the nose to the tail of the wing section, and c is the chord (e.g. front to back dimension; the length of the cord line) of the wing.

Similarly, from this handbook and other sources, for a planing surface, the two-dimensional lift coefficient, $C_L$, at small $\alpha_o$ is given by:

$$C_L=0.9\pi(\alpha_o+2f/c), \quad (2)$$

For three dimensional lift coefficient, $C_L$, and a surface which is flat in the width dimension, $C_L$ is approximately:

$$C_L=0.9\pi(\alpha_o+2f/c)A/(2+A), \quad (3)$$

where $\alpha_o$ is the attack angle, f is the maximum camber of the wetted planing surface, c is the chord of the wetted length of the planing surface at a given speed and load, and "A" is the aspect ratio. Aspect ratio, A, is given by the equation $A=b^2/\text{area}$, where b is the width of the planing surface and "area" is the wetted planing area. More accurate values of $C_L$ for a flat surface are given by Daniel Savitsky, in "Hydrodynamic Design of Planing Hulls". Note that hereafter, f is used to mean the maximum camber of the wetted planing surface.

If the wetted planing length includes the above mentioned front rocker, which is a common feature for watercraft expected to transition from displacement mode to planing mode, then "f" is negative and $C_L$ is considerably less than that for a flat planing surface having the same wetted length and area. In sailboards and most planing watercraft, this leads to a peak, or larger peak, in the drag when attempting to go from a displacement mode to a planing mode. In power boats it leads to $\alpha_o$ increasing to a value much bigger than is optimum and sometimes even produces cavitation of the propeller (i.e. "prop").

While rocker (negative values of "f") decreases the planing force (i.e. the lift force on the planing surface), camber (positive values of "f") can have even worse effects on the performance of a planing surface of a planing hull. Camber at the stern of the hull of a planing power boat, also known as hook and camber, can cause severe porpoising. Even though a cambered surface with $\alpha_o=0$ has no dynamic drag while still having lift, porpoising and the force of the water on the front can cause a watercraft to submerge at the bow.

In general, drag is undesirably increased for a planing hull with a camber at the stern due to the increased wetted area that results from a reduced planing angle. Three examples of this type of camber are given in European patent no. 0059345, and U.S. Pat. Nos. 3,274,966 and 5,582,123.

The effects of net concavity/camber in the longitudinal direction include: 1) at transition speed it will increase the transom depth thus increasing the hump drag and/or 2) will push the bow into the water at high speed. If it does, the drag will be larger. Hump drag is a peak in drag often occurring in the transition mode of a watercraft.

Various hull designs have been developed in an attempt to overcome drawbacks of a mono-hull with a front rocker. Tunnel boats, for example, are efficient in displacement mode and at high planing speed, but due to a reduced planing surface, they require achieving much higher speeds as compared to mono-hulls in order to transition from displacement mode to planing mode.

U.S. Pat. Nos. 3,149,351 and 4,843,988 teach the use of a slot alongside of a planing surface to reduce drag. U.S. Pat. No. 6,138,601 teaches the use of slots above a winglet which are trim tabs at the rear corners.

U.S. Pat. No. 5,456,202 teaches the use of a planing surface in front of a total center of gravity. It is not inclined at a larger attack angle than the other planing surface and is rockered in the front like a normal mono hull power boat. These hulls have the problem that when transitioning to planing mode the step causes turbulence and additional wave drag.

U.S. Pat. No. 3,802,370 teaches a planing surface with a portion having an incline relative to the rest of the planing surface; however, it consists of two longitudinal surfaces which are small and narrow in width compared to the other planing surfaces.

U.S. Pat. No. 6,138,602 describes a hull with a cambered front and a rear planing surface which is rockered in the middle where it would normally be in the water when planing. Thus it would have a downward suction force that will reduce its efficiency at slower planing speeds.

U.S. Pat. No. 4,924,742 teaches using three point planing, a concept which is generally well known in the art. The general concept is to have two sponsons in front of a hull's center of gravity, both sponsons extending below the remaining surfaces of the hull's underside. Various shapes for the sponsons are known. Such three point hydroplanes are designed for planing at over 40 mph. The width of a sponson planing surface is small compared to the width of the hull. This together with the drag behind the sponsons causes the lift/drag to be small when transitioning to the planing mode. Such hulls have the problem that when transitioning to planing the sponsons cause turbulence and additional wave drag, and since the size and lift of the sponsons is small, increased speed is needed for transitioning to planing mode.

Keller in U.S. Pat. No. 7,793,604 and W. Sottorf in NACA TN No. 739, 1934 show that angling or curving the outer edges of a planing surface can increase lift/drag efficiency. Keller shows that a 14° angled/curved outer edge is more efficient than a flat edge. Sottorf shows that surface with a 10 degree dead-rise which curves down at 23° is more efficient than a flat surface for planing angles >6° and has a higher maximum lift/drag vs. planing angle. Sottorf also shows that for a 48° dead rise, a 28.7° edge angle is better than both 0.0° and 48° outer edge angles.

Blount, D. L. and Codega, L. T. in "Dynamic Stability of Planing Boats" Marine Tech. Vol. 29, No. 1, January 1992, pp. 4-12, have shown that hydrodynamic forces on a rocker surface can cause suction, similar to that on the top surface of a wing, and that this can lead to bow down and unstable conditions both in the longitudinal and transverse directions. They and others like Brian Hinde have suggested using steps near this front rockered surface to correct this downward suction force.

Clement, E. P., "A Configuration for a stepped Planing Boat Having Minimum drag (Dynaplane Boat)" and Johnson, V. E. Jr., "Theoretical and Experimental Investigation of Supercavitating Hydrofoils Operating Near the free water Surface" NASA tech. *Report R*-93 1961. Second edition describe a motorboat design optimized for speeds of 40 to 80 mph and more. The planing surface is small, with a design aspect ratio of 2. At the hump speed, the resistance is shown to be larger than that for a normal motorboat with the same dead rise angle. "Hump speed" is used to refer to the transition speed at which a peak in drag/lift is observed over the range of transition speeds.

Harper, J. A., U.S. Pat. No. 8,122,840 uses a Johnson 3 term camber on the back part of a displacement hull.

For power yachts, size and speed affect the ideal shape. The high speed power boats might be a tunnel boat, a so called cigarette boat, or a three point hydroplane type. For a somewhat lower speed, they may preferably be a type of deep Vee hull. However, particularly in bigger yachts where their size requires a lot of power and a lot of fuel, there is a need for improved efficiency in speeds of 20 mph up to about 35 mph.

SUMMARY

In an embodiment, a watercraft hull is provided having large planing lift and efficiency (i.e. lift to drag ratio) at low speeds of, for example, about 6-15 mph for a sailboard and 12-30 mph for a yacht.

Generally, a watercraft hull according to an embodiment is dynamically stable even in choppy water. It has a large range of planing speeds (8-25 mph or more for sailboards, 12-80 mph or more for power boats, and 12-35 or more for large yachts).

Exemplary embodiments furthermore have a smooth flow of water around the hull with minimal wave and turbulent drag, particularly at transition speeds.

To achieve the foregoing and other advantages, a watercraft hull has a main planing surface wherein at least the back 20% has a planing angle which is greater than an average planing angle for the hull. The main planing surface, which may also be referred to as a high lift surface, is cambered with the possible exception of roughly the front ⅔rds. That is to say, at least the back one third of the main planing surface is cambered. This bears some similarity to the bottom surface of some cambered wings, foils, and supercavitating foils. The maximum width of the hull and a front edge of the at least a back one third of the high lift surface are preferably at the same longitudinal position plus or minus 15% the length of said hull. The front part of the high lift planing surface can have negative camber (i.e. rocker), which decreases the average planing angle of the cambered part and thus decreases the dynamic drag. The beam of this surface is greater than ⅔rds of the hull width.

Even at the highest intended speed of a watercraft hull, the center of lift of the high lift surface should be in front of or near the center of gravity of both the hull and the load, i.e. the total center of gravity, CG. The center of lift of the high lift surface is closer to the longitudinal midpoint of the mean wetted surface length (about 65% of the mean wetted length) of this surface from the end of the mean wetted surface length at a given speed, especially as compared with a flat or rockered surface. In the case of a flat or rockered surface, the center of lift is much closer to the start of the wetted surface.

Part of a high lift surface may be the bottom of a wing/winglet. In embodiments having this feature, a main purpose of the wing or winglet is to allow water which flows over top the wing/winglet to smoothly combine with water flowing under the wing/winglet, thereby reducing the turbulence and wave drag of the hull. The top surface of the wing/winglet can also provide some lift.

In an embodiment having one or more wings or winglets, a wing/winglet can also reduce the bow wave by providing an area in which the length is about 5-20 times larger than its width. To increase reduction of drag, the hull can have slots above the back and/or front of the wing, such that the water during displacement, transition, and slow planing modes of operation can flow smoothly around the center of the hull. Slots which may be used in accordance with the invention include those taught in PCT/US2010/029785 and U.S. patent application Ser. No. 13/946,798 by the same inventor, the complete contents of both references being hereby incorporated herein by reference. One or more back slots can allow for a smaller transom width and/or further reduce the transom's depth below the water level, particularly at displacement and transition speeds. These effects serve to further reduce the hull's drag in transition mode.

A watercraft hull according to an embodiment has a cambered planing lift surface (hereafter referred to as a front lift surface) in the front 40% of the length of the watercraft. This front lift surface preferably supports <50% of the total planing lift of the hull and more preferably <30% of the total planing lift of the hull. This surface can provide a larger minimum value of the planing attack angle $\alpha_o$, particularly at high planing speeds. For very high planing speeds, the cambered front lift surface can have limited width or be separated into two parts. In this way the main planing surface will normally have a part which is wetted, and as a result three planing areas are formed from the main planing surface (i.e. the high lift surface) together with the front lift surface.

The hull preferably has a back planing surface in back of the high lift surface. This back planing surface together with the high lift surface and the front lift surface controls the attack angle ($\alpha_o$) when in planing mode. As a result, at higher planing speeds the hull is stable and porpoising is minimized or prevented. A back planing surface in back of a high lift surface should be narrower, preferably about ½ the width of the end of high lift surface. The back planing surface preferably forms over about 15% of the end/rear of the hull. The back planing surface can taper to zero at the transom. An advantage of the narrower back planing surface is reduction of the drag due to the width and depth of the transom. It is preferred that both the back of the high lift surface and some part of the back planing surface be cambered with increasing camber toward the end of said surfaces for some smaller watercraft like sailboards (the end being a rearward portion as determined longitudinally with respect to the hull).

In some embodiments it is preferred that there is another planing area/surface at the back/rear of the hull which is at a higher height such that at slow planing speeds it balances the lift from the cambered front lift surface and/or the front of the high lift surface. For higher planing speeds this additional planing area/surface can have a height which keeps most of it out of the water.

In some embodiments, a back planing surface is over a part of the watercraft which should not be ventilated, such as a fin or propeller. For such cases, a back planing surface should be a smooth continuation of a center rockered keel area. This back planing surface can be cambered, and for embodiments having a propeller configured to operate with a portion above the water, the back planing surface can be stepped from that of a high lift surface and the center keel area. A suitable step includes that which is disclosed in PCT/2009/057138, the complete contents of which are hereby incorporated herein by reference. This step offers the advantage of limiting additional drag at slower speeds.

For sailboards, a back planing surface can be an extension of the keel area of the high lift surface, and for yachts and power boats it can be recessed into the hull behind a camber/slope step or a combination of the two.

To further increase lift, a high lift surface may be concave downward in the transverse direction toward the edge for confining or reducing water outflow. Particularly for sailboards, the curve downward may change to a curve upward at the edge of the hull to provide a soft rail. Keller in U.S. Pat. No. 7,793,604 teaches an optimum downward curved angle is ≥14° for purposes of lift, while W. Sottorf in NACA TN No. 739, 1934 shows that for a 48° dead rise 28° is better than both 0 and 48°. These teachings can be used with the practice of the invention. For a flat or small dead rise near the keel area and for slower speeds, the downward curve in the transverse direction may be roughly 20°. Those of skill in the art will recognize this angle may vary depending on the length of the downward curve, and angles for specific embodiments may be determined by routine experimentation and/or basic geometrical calculations. While angling or curving the outer edges of the planing surfaces can increase the lift/drag efficiency, it can also increase the rolling instability. For sailboards, roll is controlled by a sailboarder, and thus this possible drawback is minimized. However, for yachts and power boats it is preferable to flatten and/or slightly round the rail similar to the rail in a slalom water ski. This reduces the lever arm of the elevated side versus the deeper side, because the water on the elevated side will clear at the end of the curve, similar to the effect of a step.

Another purpose of this front lift surface is to control $\alpha_o$ if the center of pressure on the high lift surface is behind the CG, and thus to maintain a high efficiency, i.e. lift/drag. For this purpose the bottom part of the front lift surface should be cambered.

For many watercraft, a front lift surface should be divided into two surfaces. The first is a lower cambered surface for controlling $\alpha_o$. This may have a triangular shape in plan view to slice into smaller waves for a smoother ride as in Peter Payne's Seaknife watercraft. The second surface is an upper surface which raises the bow over large waves.

To add longitudinal stability in choppy water and waves, the front of the hull can have a second front lift surface at a planing angle on the order of 15°, which serves to lift the nose of the hull when the wave or chop would attempt to override and submerge the nose of the hull (and thereby add considerable drag). In embodiments having a front lift surface and/or a second front lift surface, the front lift surfaces take the place of the normal bow of a rockered hull. Since it has been shown by Blount et al. (referenced above) that rockered surfaces generally produce a downward suction force, it is preferred that a front lift surface and a second front lift together have one or more steps to reduce or eliminate this downward force. These steps should not be above another surface. This is preferable so that the hydrostatic pressure in the water, and not a surface which is part of the hull, turns the water. The purpose of one or more front lift surfaces and the steps in it are to give the hull dynamic stability for normal waves and chop and for movements which shift the center of gravity. Things which can shift the CG slightly in a yacht are the amount of fuel, where some load is stored, or movement of people.

In some embodiments, a hull according to the present invention reduces resistance at transition/hump speed and also gives lower than normal resistance in the 20-30 mph range, even to the point where a "hump" in the drag characterization is lower than the drag at the start of planing mode for some embodiments. Hump speed drag is a peak in drag in the transition mode of a watercraft.

This invention can greatly improve that efficiency of a planing mono-hull or even a tunnel/catamaran, or trimaran. It may also be used for a bass type boat up to about 60 mph or more.

DESCRIPTION OF THE DRAWINGS

The foregoing and other objects, aspects, and advantages will be better understood from the following detailed description, in which:

FIGS. 5A1-5A3 show multiple features in FIG. 5A for camber and slots separated out into multiple figures for clarity;

FIG. 7 shows experimental results for four sailboard models, of which Series 2 data is for a model according to the present invention;

FIG. 8A shows experimental results for three yacht models, of which Series 1 and Series 3 data are for models according to the present invention;

FIG. 8B shows data from a related publication;

FIG. 9 shows experimental results of data collected for yet two additional models of a sailboard according to the invention;

FIG. 10 shows experimental results for two models of a yacht according to the present invention;

DETAILED DESCRIPTION

Figure 1A:
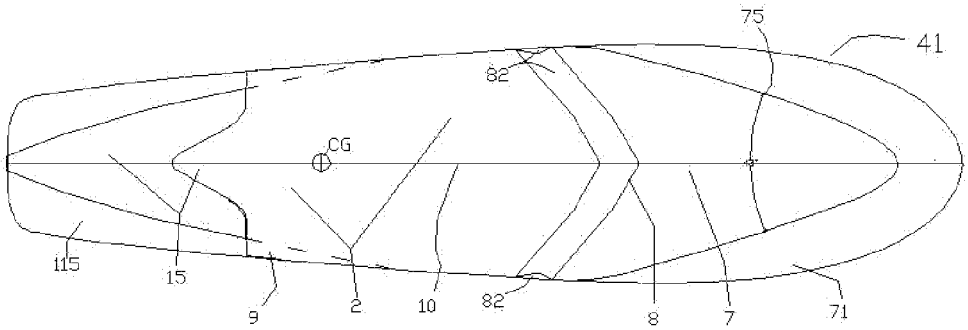
FIGS. 1A-1C show, respectively, a bottom plan view, a side view, and a top plan view of an embodiment for a yacht/power boat.

For the purposes of this disclosure, "planing mode" is defined as the lift being mainly hydrodynamic lift (≥90%) and when the hydrostatic lift is ≤10% of the total lift. "Displacement mode" is where the lift is mainly hydrostatic and the drag vs. speed is increasing nonlinearly with increasing speed. As used herein, "displacement mode" is used to indicate that ≥70% of the lift is hydrostatic lift and the remaining lift (≈30% or less) is hydrodynamic lift. Thus the board or watercraft hull is in "transition mode" when the hydrostatic lift is between 70% and 10% of the total lift and the hydrodynamic lift is most of the remaining lift, that is, 30% to 90%. In "transition mode", the drag vs. speed normally goes through a hump or peak, but this is not always the case if the weight is small or the wave drag is sufficiently reduced.

The main drag forces for a hull in planing mode are the dynamic drag, which is the dynamic force in the backward direction, and the skin friction. The main drag force in displacement mode is wave drag, which is the difference of pressure on forward facing surfaces and backward facing surfaces. In transition mode, all three—dynamic drag, skin friction, and wave drag—are important, with wave drag and dynamic drag being the most important.

It should be noted that that although some features of the invention are described in the context of particular exemplary embodiments disclosed herein, these features are not limited to the embodiment providing such context. Features which correspond across various embodiments described are identified by the same numeric identifier.

Unless otherwise noted, the watercraft hulls discussed herein and shown in the figures are generally symmetrical across a longitudinal plane of symmetry. For clarity, some structures are numerically labeled only on a starboard side or only on a port side of the boat although the structures are present on both sides. Furthermore, features (e.g. a planing surface) which are bisected by the longitudinal center line of the hull may be discussed in the singular and have a reference number pointing only to the left half or right half. It should be understood that the center line of the hull does not define a limit to a feature, region, surface, or structure to which a reference number points unless such intent is clear by the context of the reference numeral as discussed herein.

One way in which the performance of a watercraft hull may be characterized is by a dimensionless Froude number. Froude numbers are dimensionless and allow for comparison of watercraft hulls of different size. Using a Froude hull length number ($F_l$), $$F_l = v/(gl)^{1/2}, \quad (4)$$

where V is hull velocity, g is acceleration due to gravity, and l is the watercraft hull length.

Note that v, g, and l must be in the same unit system so that $F_l$ is dimensionless. For this invention, approximate Froude hull length numbers for the different modes/speeds are as follows:

| | |
|---|---|
| Displacement mode/speeds | <0.47 |
| Transition mode/speeds | 0.47 to ≈0.75 |
| Planing mode/speeds | >0.7 to 0.8 |
| Planing mode/High planing speeds | >1.55 |
| Planing mode/Very high planing speeds | >3.0 |

The values above for transition and planing speeds are below typical transition and planing speeds in the art due, for example, to the high lift surface and the resulting high efficiency thereof according to the present invention.

Figure 1B:
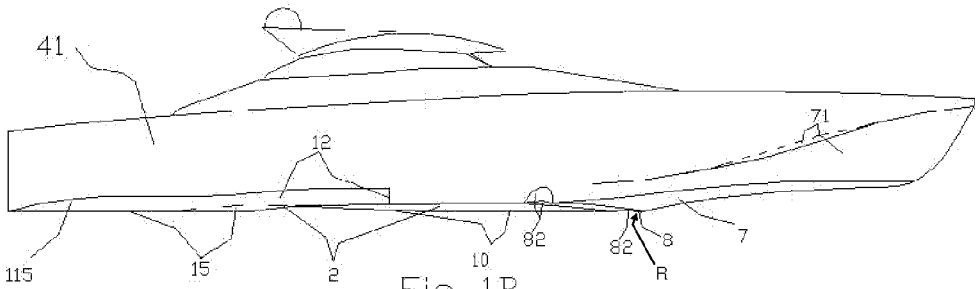
Figure 1C:
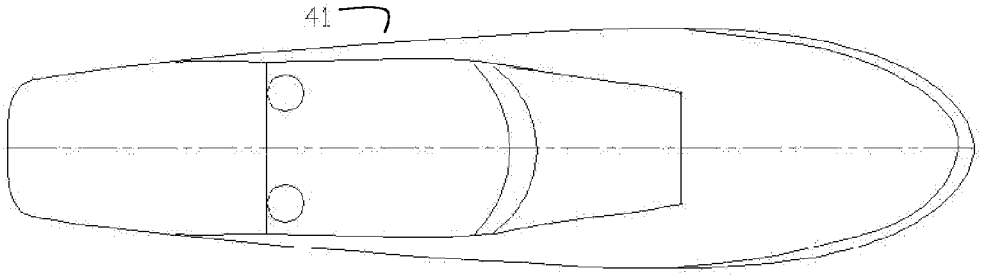

Referring now to the drawings and more particularly to FIGS. 1A-1C, a yacht hull 41 has a high lift surface 2, of which a back/rear portion (preferably at least the back 20% of the high lift surface) has a larger attack angle than the average attack angle of the hull's keel area 10 (also identified herein as keel area surface 10 or simply "S10"). The approximate beginning and end of keel area 10 can be seen in FIG. 1B. High lift surface 2 is cambered, preferably with a negative camber (i.e. a rocker) over a front portion and a positive camber (e.g. downwardly concave) over a back portion.

The amount of curvature of the rocker over the front portion of high lift surface 2 should be small enough that any negative pressure caused by it does not ventilate this surface until such speed that a step in front of it ventilates part or all of the rocker (i.e. the rocker of high lift surface 2 does not ventilate until step 8 causes it to ventilate). Thus, this rocker is much smaller than that which is the common rocker of a typical monohull in the art or the camber after it produces more lift than the down force of this rocker. As a result of the greater camber, the end planing angle of the camber/rocker surface is greater than the planing angle of the start of this surface. This is exactly opposite of what is typical for prior art, although similar to what is taught in Clement.

In general, significant features of the invention include:

1) A cambered front lift surface 7, a high lift surface 2, and a back planing surface 15, these surfaces stabilizing the flat water hydrodynamics of a watercraft hull.
2) A back/rear portion of back planing surface 15, which can be an extension of high lift surface 2 or keel area 10, forming part of the transom and, in some of the embodiments, most of the transom such that the portions remaining of the conventional transom have a reduced total transom size.

It is preferred that an average camber of the front lift surface, back planing surface, and high lift surface together is less than or equal to zero. Said differently, a line from the front of the front lift surface to the middle of the high lift surface to the back of the back planing surface generally has zero or negative camber.

In some embodiments, the mean wetted length of high lift surface 2 may be as little as about $1/5^{th}$ of its width. It is then the general case that greater camber over a back portion of high lift surface 2 gives greater f/c (see Equations 1-3) for higher speed, thus increasing the efficiency, defined as the ratio of lift to drag (i.e. lift/drag). The beam or width of high lift surface 2 is preferably greater than $2/3^{rd}$ of the hull width. A high lift surface preferably forms at least 2/3 of a portion of an underside of the hull, this portion starting 30% of the hull length from a front of the hull and ending 20% of the hull length from a back of the hull.

Configurations for a camber of the high lift surface 2 may be similar to the three term (3 term) Johnson camber as described in Clement, "A Configuration for a stepped Planing Boat Having Minimum drag (Dynaplane Boat)" page 47, the entirety of the Clement reference being incorporated herein by reference, or a five term (5 term) Johnson camber such as is described in NASA Technical Report R-93, "Theoretical and Experimental Investigation of Supercavitating Hydrofoils Operating Near the Free Water Surface" by Johnson (the entirety of which is incorporated herein by reference). A camber of high lift surface 2 may also be similar to a combination of a three term camber and a five term camber. In short, the general configuration for the curvature of high lift surface 2 is a camber in the back and a slight rocker in the front. The cambers of embodiments having a five term camber are notably more exaggerated than the cambers of embodiments having a three term camber, with more/greater camber at the back of high lift surface 2 in the former case.

"y", the three term Johnson camber from Clement above, is given by:

$$y=C_{L,d}\times c\times\{(-20\,X^{3/2})+(80\,X^{2})+(-64X^{5/2})\}/(7.5\pi), \quad (5)$$

where "y" is measured from a reference line, $C_{L,\,d}$ is the two dimensional lift coefficient for a cambered surface when the planing angle is zero, "X" is x/c, where "x" is longitudinal distance from the front of the Johnson's camber and "c" is the chord length of said camber. Note that "y" is negative for X=1, i.e. the end of the camber. This is so that when the reference line is at zero attack angle, all of the surface has a positive lift pressure.

The five term Johnson camber is treated herein as:

$$y=C_{L,d}\times c\times\{72\,X-\mathbf{2240}\,X^{3/2}+12600\,X^{2}+-30912X^{5/2}+35840\,X^{3}-15360\,X^{7/2}\}/(819), \quad (6)$$

where y=0 for X=1. Note that this equation differs from that disclosed in the Johnson reference; specifically, the first cofactor is "72" instead of "210" as in Johnson. This variation aligns the reference line to the chord line, which roughly aligns a 3 term Johnson camber with a 5 term Johnson camber.

The back of a 5 term Johnson camber is very similar to a 3 term Johnson camber. As a result, some embodiments advantageously provide approximations of both camber types such that the speed and hydrodynamic mode (e.g. displacement, planing, or transition) determine which camber is actively affecting the hydrodynamics of the watercraft. Specifically, a 5 term camber is provided over the area of the hull including the wetted length at speeds in which the boat is in transition mode or slower speeds of planing mode. The wetted planing length is reduced as the watercraft increases to high speeds in planing mode. The so called high speed wetted planing length is roughly the back/rear portion of the 5 term camber region, in particular the region representative of a Johnson 3 term camber. Thus at low planing speeds and transition speeds, the hull interfaces with the water surface via a 5 term camber, and at higher planing speeds the hull interfaces with the water surface via a 3 term camber. However, the camber in the back and the rocker in the front can be variations of this, i.e. not restricted to 3-term and 5-term.

In some embodiments, the center of lift/pressure on high lift surface 2 for high speeds is about ¾ of the wetted length from the end/rear of high lift surface 2. If this condition occurs at the maximum design speed, then the center of lift is preferably in front of and/or near of the total center of gravity, CG. The CG position for some power boats, particularly for outboards and stern drives, is located roughly in the back ¼ of the hull. For other power boats and yachts, it may be closer to the center of the hull depending on where the motor is located. Ideally, the center of lift is furthest to the back of the hull when the hull is operating at the maximum design speed. At any operation speed less than the maximum design speed, the center of lift is further forward on the hull. By "in front of and/or near", it is generally meant that in an exemplary embodiment, a center of dynamic lift of a high lift surface 2 is at or in front of a point which is a fraction of the hull length behind a total center of gravity of the hull under loading, the fraction being preferably 15% of the hull length. At least high lift surface 2 should be configured in size and longitudinal position to achieve this effect.

High lift surface 2 would result in a reduction in the attack angle of a conventional rockered bow. Instead of a traditional bow, embodiments are provided with a front lift surface 7. Front lift surface 7 is a second cambered surface in the front 40% of the hull and supports <50% of the hull's planing lift and preferably <30% of the hull's planing lift. A purpose of this front lift surface is to control $\alpha_o$ if the center of pressure on the high lift surface is behind the total center of gravity (CG), and thus to maintain a high efficiency, i.e. lift/drag. For this purpose the bottom part of the front lift surface should be cambered with a mean angle in a range of 2-10°, preferably about 4°, and end in a small step with an end angle of 7-14°. Thus this front surface camber, together with the main lifting surface, controls $\alpha_o$ when $\alpha_o$ is small. It is preferred that the center of dynamic lift/center of pressure of the high lift surface is at or in front of a point which is 15% of the hull length behind a total center of gravity of the hull under loading (i.e. the total center of gravity of the hull together with a sailor, cargo, etc. as the case may be).

At least part of this front lift surface 7 ends/terminates in at least one step, the step being configured to dewet at least a longitudinal center portion or a longitudinal outer portion of the high lift surface in planing mode. Multiple configurations for step 8 which are usable in the practice of the invention will occur to those of skill in the art. One such configuration is that taught in PCT/US2009/057138, which is incorporated herein by reference. The radius of curvature (R) of the step is on the order of 1 cm (i.e. range of 0.3 cm to 3 cm) with a depth (i.e. difference in surface location in a vertical direction) behind and near the step of less than 1 cm (for watercraft of 230 cm×70 cm size, i.e. a typical sailboard). Both the radius of curvature and depth should be scaled, however, according to the size of the watercraft for a given embodiment. Both the radius of curvature of the step and the depth behind and near the step for a given hull which is not 230 cm×70 cm may be scaled by at least one of the following factors: i) the length of the given hull divided by 230 cm, or ii) the length of the planing surface behind the step divided by 40 cm. (In the case of the sailboard measuring 230 cm×70 cm, 40 cm is the length of the planing surface behind the step.) In this way less drag is produced by a step 8, particularly in transition mode. In short, at least one of one or more steps can have a radius of curvature on both sides of 0.3-3 cm times a factor substantially equaling the length of the hull in centimeters divided by 230 cm. The attack angle of the end of front lift surface 7 can be roughly 10° (i.e. range of 5-20 degrees), preferably in the range of 8-14 degrees, relative to the back of keel area 10.

In some embodiments, more than one step 8 may be provided on one or more of front lift surfaces 7 and 71. The radii of curvature for additional steps 8 (e.g. steps 8' and 8" in FIGS. 3A-4), may likewise be scaled as given above. Such scaling applies to any step together with any planing surface which follows immediately behind it. For embodiments for yacht hulls as in FIGS. 3A-4, S71 may be divided into two surfaces 71' and 71" by a step 8'. S7 and S71 may be separated by a step 8". It is preferred that the high lift surface 2 be a 3 or 5 term Johnson camber with $C_{L,d}$ of roughly 0.1 with a range of 0.05 to 0.2, and it is preferred that the front lift surface 7 be a 3 or 5 term Johnson camber with $C_{L,d}$ of roughly 0.125 with a range of 0.05 to 0.25. Front lift surface 71, which is generally vertically displaced from S7, preferably has an average planing angle on the order of 15° (i.e. 5-47 degrees) greater than the average planing angle of the back planing surface. This range may preferably be slightly narrower, i.e. 10-35 degrees.

The planing angle at the end of front lift surface 7 (such as at step 8) can be adjusted by changing $C_{L,d}$ and the average attack angle ($\alpha_o$) of front lift surface 7. These parameters are preferably configured such that, at the highest desired planing speed, the water off of step 8 reconnects on S2.

Figure 2A:
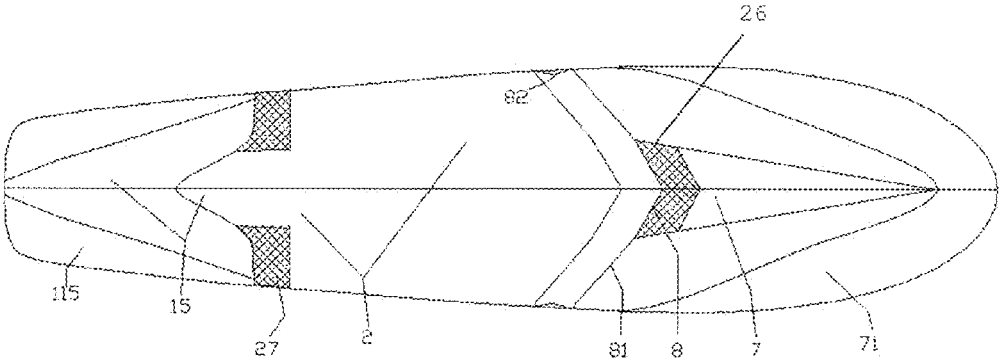
FIGS. 2A-2C show, respectively, a bottom plan view, a side view, and a top plan view of another embodiment for a yacht/power boat.
Figure 2B:
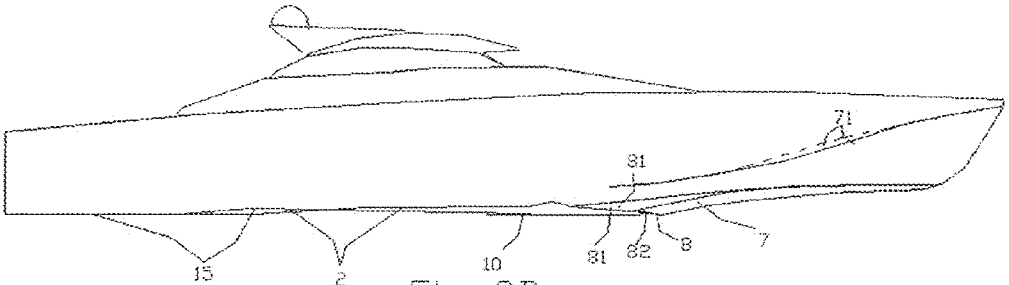
Figure 2C:
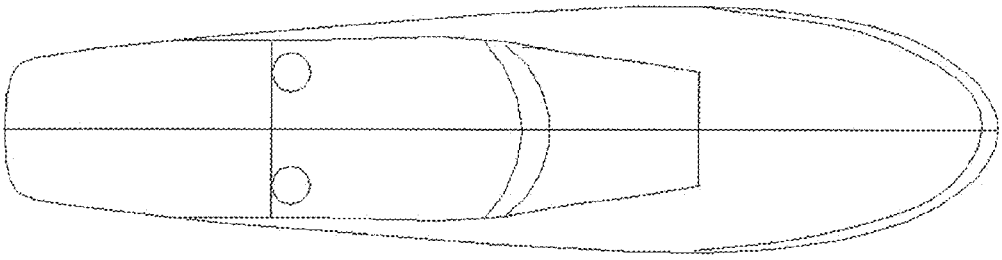

The embodiment shown in FIG. 1A has a step 8 which generally spans most of a transverse width of the bottom of the hull. An alternate embodiment of the invention is shown in FIGS. 2A-2C. In the embodiment shown, the width of step 8 is limited to a small portion, e.g. a transverse center portion corresponding with area 26, of the bottom of the hull. A step 81 is provided on either side of step 8 extending toward and to the sides of the hull. Front lift surface 7 comprises two regions 7' in addition to a region 7", as indicated in FIG. 2C. Regions 7' of the front lift surface have a smaller planing angle than region 7". Steps 8 and 81 define an end of front lift surface 7. Generally, a first step (e.g. a step 8) and a second step (e.g. a step 81) are transversely next to one another, the second step having a smaller planing attack angle than the first step such that in planing mode the first dewets a longitudinal center portion or a longitudinal outer portion of S2 behind the first step, and the second step dewets a remaining longitudinal portion of S2 which is behind the second step.

As discussed in the preceding paragraph, the end of S7 may include a central step 8 with a step 81 to either side. In planing mode, a hull according to this configuration can plane on three surfaces where one of the three surfaces is to the front of the hull and the remaining two surfaces are to the rear. FIG. 2A shows this configuration with one planing surface 26 to the front and two planing surfaces 27 to the rear. Alternatively, a hull (not shown, but similar to that shown in FIG. 11B) may have a central step 81 with a step 8 to either side. In planing mode, this hull can plane with two planing surfaces 26 in the front of the boat and one planing surface 27 in the rear. In waves surface 28 would also get wetted.

Step 81 may be smaller than step 8 or entirely absent in some embodiments. At very high planing speeds, three planing surfaces are generally achieved, similar to a 3 point hydroplane. Water which flows over/passes off of step 8 passes under high lift surface 2 (also identified herein as "S2") without making contact to at least a front portion of S2. Water passing beneath the hull to either side of step 8, such as over step 81, does make contact with S2 and thereby produces lift thereon. In short, lift can be generated on a left side of S2, on a right side of S2, and on front lift surface 7 (also identified herein as "S7"). Generally, this lift is produced on portions 27 of S2 which are to either side of the hull but not in the center (i.e. behind step 8) and are preferably toward the rear of the watercraft, as shown in FIG. 2C. The approximate location of portions 27 of S2 and portion 26 of S7 are generally indicated by hash markings in FIG. 2C as forming three planing surfaces at very high planing speeds. It should be noted that the exact size and edges of these portions of S2 and S7 may vary across embodiments and furthermore at different speeds of a watercraft for a given embodiment. Furthermore, step 8 and S2 may be configured such that the water flowing off of step 8 and passing under S2 (that is, without making contact) regains contact with the hull at planing surface 15 (also identified herein as S15), located behind S2.

An advantage of this invention embodiment is increased lift/drag efficiency at very high speeds, pushing the planing speed range higher than otherwise possible. At such high speeds, hull features contributing to this advantage include portions 27 of S2 and portion 26 of S7.

Generally, one or more steps 81 have a smaller planing attack angle than step 8 such that in waves or chop the entire length of S2 behind step 8 is not wetted, but water passing off of a step 81 reattaches to the hull before the end of S2 (that is, at a rearward portion of S2) even at the highest desired speed of the watercraft.

One or more grooves 82 may be provided behind steps 8 and/or 81, in addition to one or more grooves which may be provided on either side of the hull and which extend above the water line when the watercraft is planing. The grooves increase ventilation of the steps. Grooves 82 are shown in the watercraft depicted in FIGS. 1A-1C and 2A-2C and are particularly useful for steps 8 and 81 since they generally cannot be ventilated with air from behind the transom as is generally possible for any step behind high lift surface 2 and S15.

Back planing surface 15 (i.e. S15), can be an extension of the middle of S2, an extension of S10, or a distinct planing surface behind (that is, aft of) S2. S15 generally has a transverse width which tapers from front to rear and may have zero width at the transom. An advantage of S15 is to control porpoising and if needed prevent ventilation, for example, of a fin or propeller. One or more surfaces 115 may be provided, for example, to either side of S15 as shown in the embodiments in FIGS. 1A-2C. At transition speeds, surfaces 115 are planing surfaces which can balance the lift of high lift surface 2 and front lift surface 7. Planing surface 115 (also identified herein as S115) is outside and displaced higher than surface S15 (in the vertical direction generally corresponding with the directional axis of gravity). That is, a second back planing surface S115 has a displacement from the first back planing surface S15 in a vertical direction. A primary purpose S15 serves is to control the upper value of the attack angle ($\alpha_o$) in transition mode and generally limit $\alpha_o$. S115 preferably has a three or five term Johnson camber or similar.

Advantages of embodiments which can have three or more separate planing surfaces as described above include i) increased lift/drag efficiency and ii) a larger range of planing speeds which include lower speeds which may not conventionally correspond with planing mode. At such speeds, these advantages are largely provided by S2, S7, S15, and S115.

Particularly for watercraft where the total CG may vary depending on sailor/operator positioning relative the watercraft, the center of lift of high lift surface 2 is preferably in front of the CG for watercraft where back planing surface 15 has a camber which runs to the very end of back planing surface 15. An example is an embodiment for a sailboard wherein the planing angle $\alpha_o$ is controlled mainly by S2 and S15. Alternatively, the center of lift of high lift surface 2 is preferably in back of (i.e. aft of) the CG for watercraft where S15 has a camber only for a front portion of S15, the camber not extending to the aftmost portion of S15. In such an embodiment, $\alpha_o$ is controlled mainly by S2, S7, and/or S115 at low speeds. The largest transverse width of planing surface 15 is preferably about ⅓ of the width of S2 at an end/aftmost portion of surface 2. However, the largest width of S15 may be any value in the range of 10% to 80% of the width of an end portion of S2. Furthermore, the length of S15 can be 5% to 30% of the hull's total length.

Back planing surface 15 can prevent ventilation of a fin or propeller. Depending on the desired reduction or prevention of ventilation to the fin and/or propeller, a width and length to S15 can be selected by simple calculation and/or routine experimentation. S15, as shown in FIGS. 1B and 2B, can be cambered such that the end of the camber has an attack angle approximately identical to that of the end of surface 2.

As shown in both embodiments for yachts in FIGS. 1A-1C and 2A-2C, front lift surface 7 has a somewhat narrow angle in a transverse direction for slicing through small waves, to give a smooth ride. A transverse angle which may be used in the practice of the invention is taught by Peter R. Payne in his well known watercraft design, the Sea Knife. Specifically, the transverse angle to front lift surface 7 is roughly 40 degrees for the embodiment shown in FIGS. 1A-1C and 20 degrees in the embodiment shown in FIGS. 2A-2C.

One or more surfaces 71 (also identified herein as S71) provide lift to the bow in conditions of large waves. Both S7 and S71 of FIGS. 1A-1C and 2A-2C provide the benefit of not having the suction of a normal rockered bow.

Figure 3A:
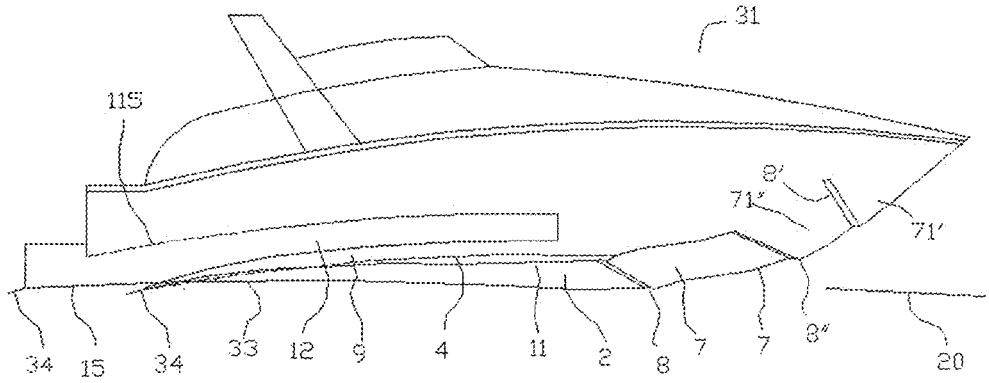
FIGS. 3A and 3B show, respectively, a side view and a bottom plan view of yet another embodiment for a yacht/power boat.
Figure 3B:
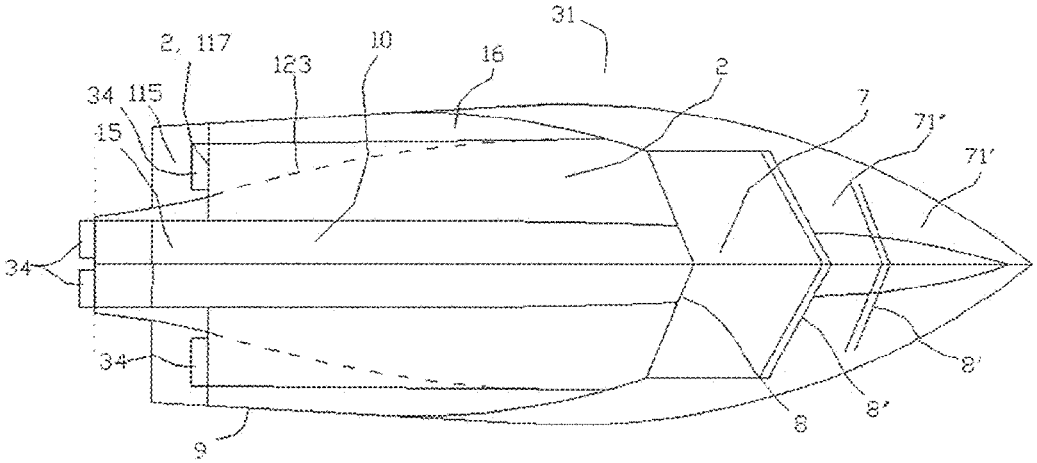

FIGS. 3A and 3B show, respectively, a side view and a bottom view of an embodiment for a mono hull yacht 31. Yacht 31 has a high lift surface 2, planing surface 15, front lift surface 7, one or more steps 8, one or more wings 9, and one or more slots 12. Front lift surface 7 can include one or more surfaces 71 and one or more steps 8. High lift surface 2 can extend from its starting position as shown in FIGS. 3A and 3B most of the way to the stern of yacht 31 with the yacht having a center of lift near the CG of the yacht. This configuration is another embodiment for a yacht which can operate in planing mode at slow speeds, where over half of the length of S2 is wetted. In the embodiment shown, hull 31 has two wings/winglets 9 and a slot 12 at least partially above at least a part of each winglet 9 such that water flows over a winglet 9 and joins water from high lift surface 2. A slot can extend behind of, in front of, or both behind and in front of each wing or winglet. The slot allows increased water flow over the wing/winglet and can reduce wave drag. A result of this configuration is only the end of back planing surface 15 forms a transom for yacht 31. Generally, it is preferred that back planing surface 15 be configured such that a center of lift of high lift surface 2 is in front of or near the CG, even at the top design speed (i.e. the maximum speed at which the watercraft is intended to operate).

A high lift surface 2, as well as the top of a wing 9, may have some downward curve 16 in the transverse direction and then an upward curve back to flat about 60-70% of the distance from the hull's midline to the hull edge. A flat or soft rail can thus be provided at the hull edge. This feature is usable to help reduce the outflow of water while maintaining some rolling stability. While angling or curving the outer edges of the planing surfaces can increase the lift/drag efficiency, it can also increase the rolling instability. For sailboards, roll is controlled by a sailboarder, and thus this possible drawback is minimized. However, for yachts and power boats it is preferable to flatten and/or slightly round the rail similar to the rail in a slalom water ski. This reduces the lever arm of the elevated side verses the deeper side when the hull heels.

Figure 4:
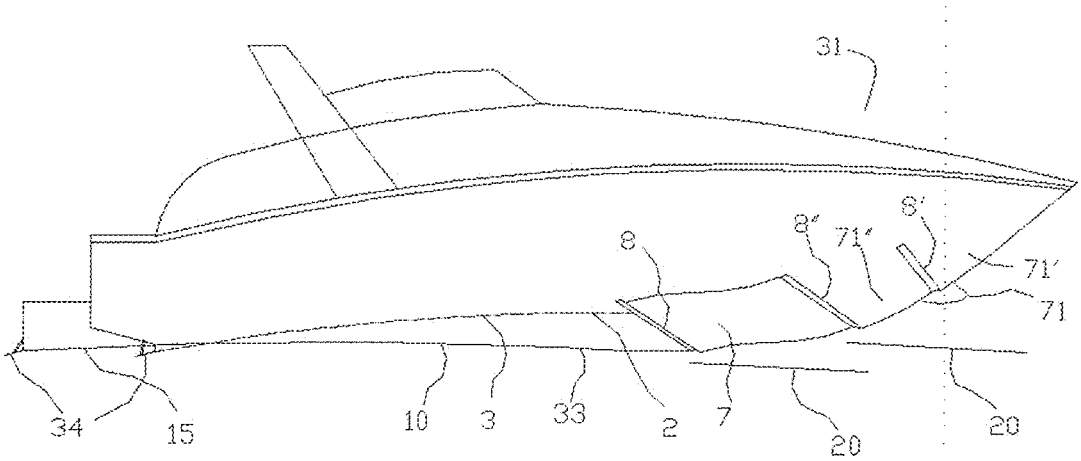
FIG. 4 shows a side view of another embodiment for a yacht/power boat.

FIG. 4 shows a variation on the side view shown in FIG. 3A. In this embodiment, there are no winglets 9 and slots 12. In both FIGS. 3A and 4, the front of high lift surface 2 is higher than an adjacent keel area. This allows for more of a deep V shape in the front of the boat, including front lift surface 7. In the transverse direction, high lift surface 2 may be generally V shaped or may have any general shape commonly used with a dead rise. The cross section of front lift surface 7 can have concave sides, where there is less deadrise at the top of the sides than at the bottom. Both a deep V shape and concave sides allow for smoother movement of a watercraft through waves.

For the embodiments shown in FIGS. 3A-3B and FIG. 4, the average attack angle of high lift surface 2 is 0.035 radians, although the average attack angle can be 0.005-0.1 radians and is preferably 0.02 to 0.05 radians greater than the average attack angle of the adjacent keel area 10. The entrance and exit attack angles of S2 are, respectively, 0.035 radians less than and 0.075 radians greater than the average attack angle (e.g. 0.035 radians). A greater camber and attack angle give more lift and efficiency when over half of high lift surface 2 is wetted by incoming water 20.

Any one or more of the high lift surface 2, back planing surface 15, and keel area 10 may have a camber 33, such as a three term Johnson camber or similar. A camber 11 for high lift surface 2 generally has a larger $C_{L,\ d}$ and smaller chord length "c" (as given in the equations above). In some embodiments, high lift surface 2 can have strakes on it.

An important distinction exists between embodiments for a sailboard and embodiments for a powerboat/yacht. In the case of a sailboard, the sailor can adjust the CG of the sailor-hull combination by adjusting his position on the board at a given speed. This allows the sailor some control over the planing angle ($\alpha_0$) of the sailboard. In the general case of a yacht, however, the sailor cannot adjust the location of the CG at different speeds. That is to say, the location of the CG of a yacht is generally fixed and constant as a result of the larger mass of the yacht. The mass of the sailor is generally insignificant such that the sailor's position on the yacht has negligible impact on the total CG of the sailor/yacht combination. Provided this consideration, it is especially important for a yacht that proper structural means be used to control the planing angle ($\alpha_0$) at transition and planing speeds. It should be noted, however, that varying amounts of fuel in a yacht's fuel tank(s) or a large concentrated number of passengers can impact the total CG of a yacht.

For high speed planing, the beginning of the wetted surface shifts back along a longitudinal direction of a hull. The shift in the starting location of the wetted surface can shift the center of pressure from the water near to or even slightly behind the CG of the watercraft. This shift is generally undesirable. To counteract this shift the invention includes cambered front lift surface 7 for controlling the planing angle ($\alpha_o$) at high planing speeds. Hence the combination of back planing surface 15, front lift surface 7, and high lift surface 2 will dynamically control the planing angle over the planing speed range. Front lift surface 7 preferably slopes/angles back similar to the front edge of a jet wing as in the Clement's Dynaplane reference cited above. This has the desired effect that the ends of step 8 are roughly at the same depth as the center of the step (e.g. when the hull is at rest). As a result, the ends of step 8 do not pass over water near the outside edges of front lift surface 7, causing the water to miss the step and undesirably make contact near the front of S2. This would result in an increased wetted surface and thus increased drag. Said differently: providing step 8 at a constant depth in the transverse direction—at least at each of the ends and center of step 8—allows water to uniformly pass from S7 and over step 8 such that the front portion of S2 which is behind step 8 is dewetted at high planing speeds.

In some embodiments, a swept back hydrofoil may be used near front lift surface 7 to aid in the control of the high speed planing angle (i.e. the planing angle of the hull at high speeds when the hull is in planing mode). A swept back hydrofoil generally runs near the water surface at such high planing speeds.

One or more hydraulic trim tabs 34 can be used behind high lift surface 2 and/or back planing surface 15 or surface 115 to increase the effective $C_{L,d}$ of surfaces S2, S15 and/or S115 and for adjusting the trim angle at transition and slower planing speeds. They can be out of the water and spray streams for speeds near or at the maximum design speed of the hull (i.e. the fastest speed at which the boat is designed to operate). These trim tabs can also be cambered in the longitudinal direction to match a camber of S2 and/or S15. While for simplicity these trim tabs are not shown in FIGS. 1A-1C, 2A-2C, and 11A-11B, it is preferred that they be used in these embodiments to further control the planing angle in transition mode and to trim any heeling (i.e. a transverse angle) due to load, waves, or wind.

In addition, the planing surface 115 and the top of slot 12 (shown behind a winglet 9 in FIGS. 3A-3B) can provide lift, for example in the back of the hull, at transition speeds and slow planing speeds. At higher planing speeds these features will generally be mostly above the water flow.

Figure 5A:
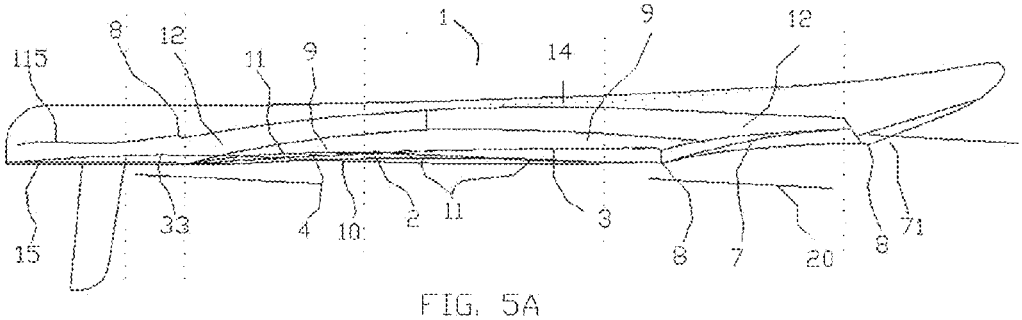
FIGS. 5A-5C show, respectively, a side view, a top plan view, and a bottom plan view of an embodiment for a sailboard.
Figure 5B:
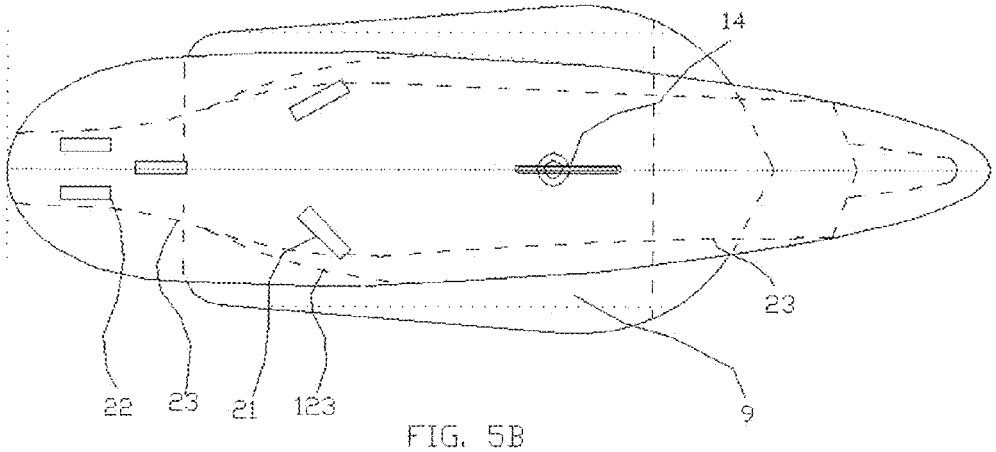
Figure 5C:
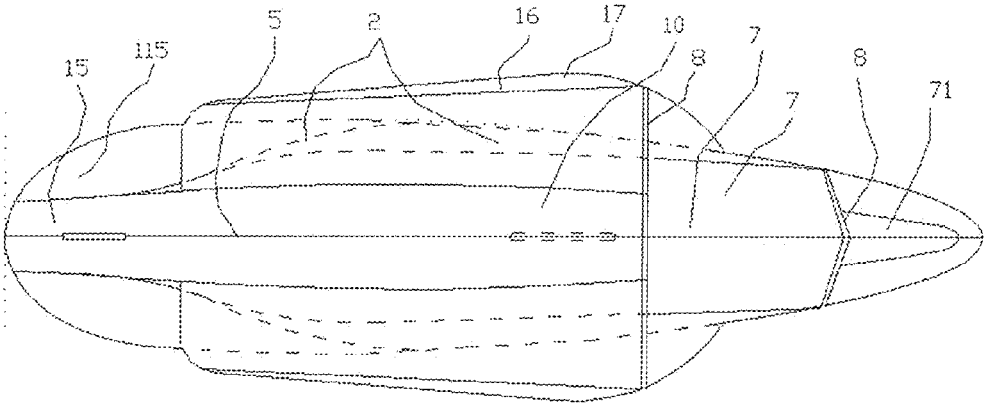

An embodiment for a sailboard hull 1 is shown in FIGS. 5A-5C. Analogous elements to the embodiments for a yacht described above are labeled by the same reference numerals. A sailboard hull generally includes a slot (which is for a sail mast foot 14), front foot straps 21, and back foot straps 22. FIGS. 5A1-5A3 are simplified reproductions of FIG. 5A; each shows a subset of the features shown in FIG. 5 to improve clarity of understanding each feature. In viewing FIGS. 5A-5C, 5A1-5A3, and 5D, it is also worthwhile to note that camber 11, curve 3, and curve 4 are all features of high lift surface 2, and camber 33 is a feature of keel area 10. It is also important to note that camber 11 and curve 3 are alternatives. That is to say, high lift surface 2 may be characterized by camber 11, curve 3, or a similar curve/camber. Thus, the sailboard hull 1 shown in the figures is representative of different curves which may be used for S2 for multiple variations of the invention.

Sailboard hull 1 has a high lift surface 2, at least the back 20% of which has a larger attack angle than an adjacent rockered keel area surface 10 (i.e. "S10"). The greater attack angle of S2—shown in the figures as 0.025 radians—can be 0.005 to 0.2 radians and is preferably on average 0.02 to 0.14 radians greater than of the attack angle of S10. High lift surface 2 is cambered with, for example, a constant curvature as shown in FIG. 5A at curve 3 or a larger camber in the back as compared to the front, such as shown at curve 4. In some embodiments, it is preferable that high lift surface 2 has a negative camber in the front and a positive camber in the back. More camber in the back gives greater f/c (in reference to the equations above) for higher speeds where the mean wetted part of S2 may be as little as the last 20 cm of S2, thus increasing the efficiency, i.e. lift/drag. The width of S2 should be greater than $2/3^{rd}$ the hull width. The camber can also be a three term or five term Johnson camber as discussed above in relation to the embodiments for a yacht or powerboat.

Camber 11 of high lift surface 2 is similar to a 3 term Johnson camber, and camber 33 of keel area 10 and an extension thereof is similar to a 5 term Johnson camber. These are preferable because 1) they have more lift/drag and 2) these two cambers 11 and 33 produce a better match in elevation between keel area 10 and S2, as seen in the cross sections in FIG. 5D. That is, there is less transverse convex curvature in keel area 10, which means less downward force for any transverse water flow.

A sailboard has a yaw angle to provide side lift on the sailboard fin to counter the side lift on the sail. The sailboard fin is normally near the back of the sailboard, generally in the back 20% of the sailboard. In some sailboard hulls like "stand up paddle", SUP, the fine or centerboard (a movable fin) will be closer to the center of the sailboard. This yaw angle puts a side force on the leeward side of the sailboard. Thus surface 15, which for sailboards desirably protects the fin from ventilation, extends to the end of the board and generally must be in the water by the fin. For the sailboard embodiment, S15 is an extension of the keel area surface 10 (i.e. there is no step on S15 or between S15 and S2). In this embodiment, S15 is wider at the end for controlling ventilation. For embodiments having this characteristic, significant features for controlling planing angle include S15 and S2. However, S7 and step 8 also control the planing angle when the planing angles are small, for example 1 to 4 degrees.

For embodiments for a sailboard, S15 and keel area 10 preferably form a 3 or 5 term Johnson camber over the high planing speed wetted surface. The center of lift/pressure on surface 2 at high speeds may be only about ¾ of 20 cm (i.e. approximately 15 cm) from the back end of surface 2. If this corresponds to the maximum design speed, than this center of lift, shown as point 5, should be in front of the total center of gravity, CG. This CG position is roughly between ¼ and ½ of the distance from the front foot straps 21 to back foot straps 22, when the sailboarder is in the foot straps and sailing fast.

As previously stated, in this embodiment and similar embodiments S7 and step 8 control the lower limit of the planing angle ($\alpha_0$) of the board/hull and the amount of wetted surface area on S2.

Figure 5D:
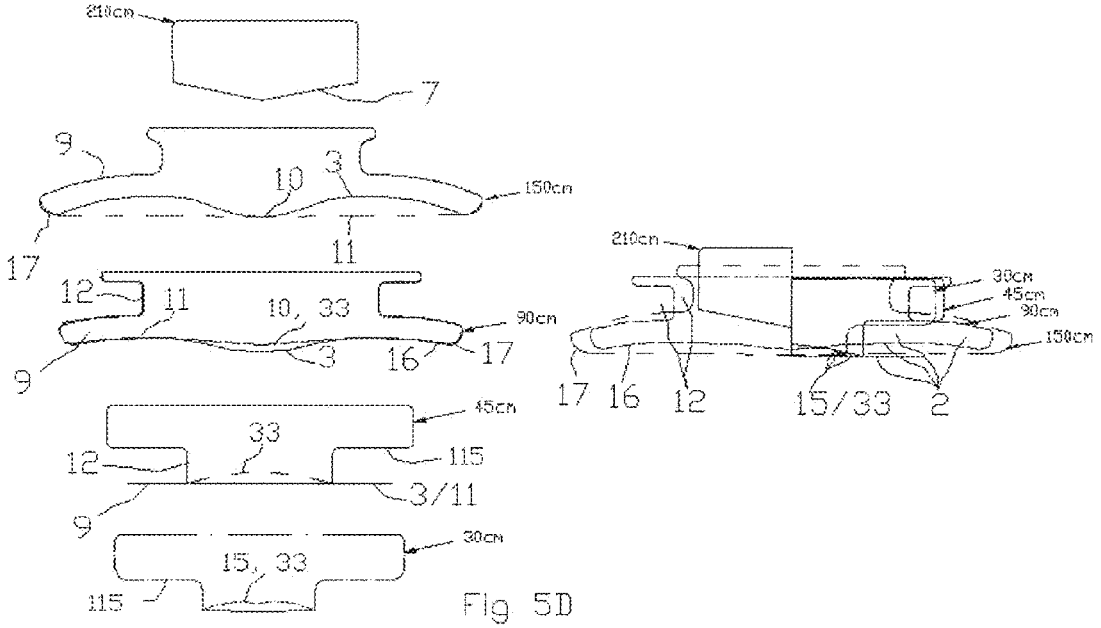
FIG. 5D shows cross-sections, both individually and superimposed on one another, of the sailboard shown in FIGS. 5A-5C.

Preferably the high lift surface 2, as well as the top of the wing 9, have a downward curve 16 in the transverse direction. This reduces the out flow of water. These angles and depth should be greater in the front part of S2, which is a wetted surface at slower planing speeds and smaller in the back to reduce wetted surface at high planing speeds. Likewise, the front side edges of S2 should also have an upward curve 17, such as is shown in FIG. 5D. This makes the edge rail "softer", so the sailboard hull 1 may be more easily pushed off of the wind. Sailboards, when sailing across the wind, have an angle of yaw that gives the fin a transverse lift. The soft rails produce less side force from this yaw on the front of the hull, which allows the fin to be located further forward toward the CG. A yaw of a hull plus a convex (i.e. having negative concavity) transverse surface on the underside of a sailboard can produce the equivalent of a rockered surface in the direction of water flow. This is undesirable, and as such the amount of transverse convex curvature of S10 for sailboards should be kept small and/or the transverse curvature should have a V shape at the center such that it can act in a manner similar to a step to the transverse water flow. "Small" is used here to mean substantially the same as the rocker curvature of the front of a 3 term Johnson camber, or ($1.2\times C_{L,d}/c$), in the direction of the water flow, or about (0.6/tranverse length) in the transverse direction.

FIG. 5D shows the cross sections for the embodiment for a sailboard as shown in FIGS. 5A-5C. These cross sections are taken, as measured longitudinally from the back of the sailboard, at 30 cm, at 45 cm (i.e. approximately the line of the back of the wing 9), at 90 cm, at 150 cm, and at 210 cm (i.e. approximately the line of the front of the wing 9). The total length of the hull 1 in FIGS. 5A-5C is 250 cm, but can be any desired length. As seen cross-sectionally from the stern to the bow of the sailboard in FIG. 5D, one can see the additional attack angle and camber of high lift surface 2 from the start point of S2 and extending back to cross-sections at, for example, 150 cm and 90 cm. At least a portion of S2 can have camber 11. In the case of FIG. 5D, camber 11 can be seen starting behind the start of S2 after a slight rocker. Wing 9 curves downward in the transverse direction on both the top surface of the wing and at curve 16 on the bottom surface of the wing (which forms part of high lift surface 2). The bottom surface of the wing curves back up at 17 to give a soft rail in the front part of the wing 9. The front lift surface 7 is seen on the cross section taken at 210 cm and the back planing surface 15 is seen on the cross section taken at 30 cm.

The vertical dotted lines in FIG. 5A represent cross sections taken and illustrated in FIG. 5D. In FIG. 5D, individual cross sections are shown on the left, and superimposed cross sections are shown on the right. Dashed lines are used to represent a hull characterized by camber 33 (of keel area 10) and camber 11 (of high lift surface 2). A variation of the hull which uses camber 3 in place of camber 11 is shown with a solid continuous line. Where edges/surfaces of the two hull variations are identical, only a solid continuous line is used (this being the same result as superimposing the dashed line hull and continuous line hull). For the superimposed cross sections shown on the right side of FIG. 5D, cross sections taken at 30, 45, 90, and 150 cm from the back of the hull are shown on the right side of the center line and cross sections taken at 90, 150, and 210 cm from the back of the hull are shown to the left of the center line.

The slots 12 above the wing 9 are seen at the cross sections taken at 90 cm and 150 cm. The front and back of these slots 12 are the space under front lift surface 7 and the space alongside back planing surface 15.

Figure 6A:
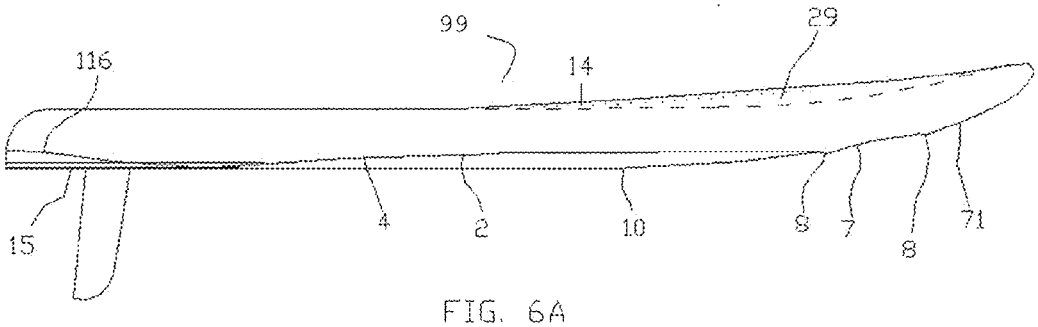
FIGS. 6A-6C show, respectively, a side view, a top plan view, and a bottom plan view of another embodiment for a sailboard.
Figure 6B:
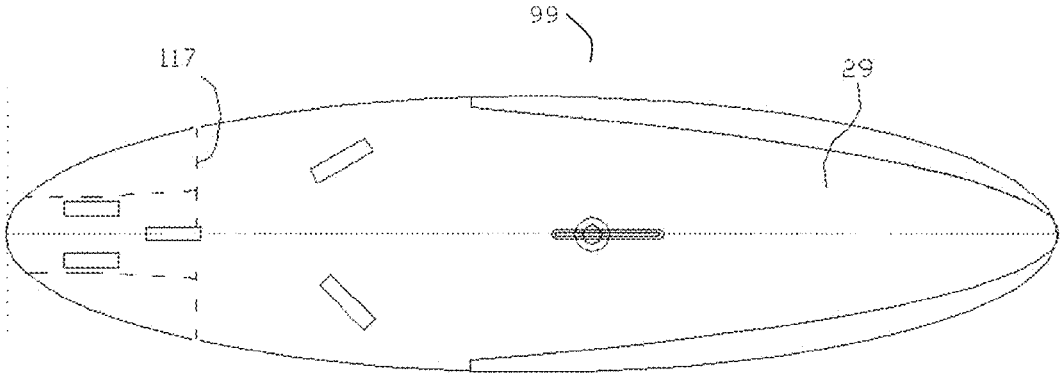
Figure 6C:
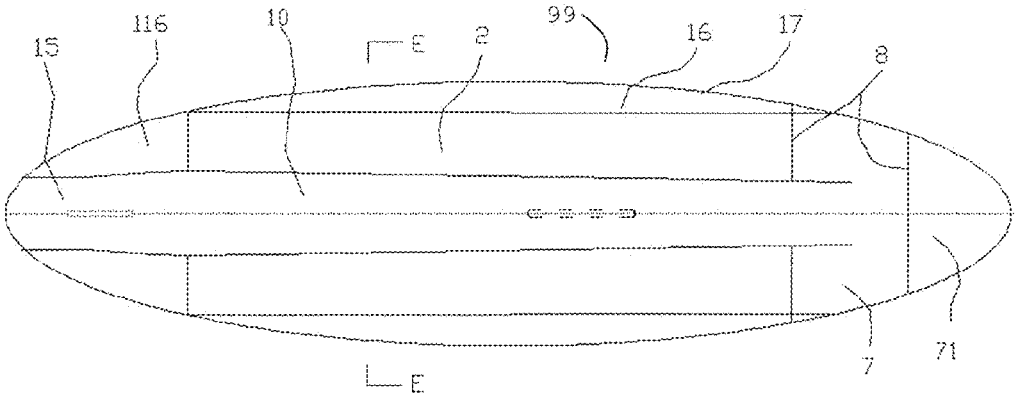

FIGS. 6A, 6B and 6C show an embodiment for a sailboard hull 99 which does not have slots 12. The top surface 29 of the hull may have the shape of an upside down wing for preventing the nose of the hull from suddenly shooting upward in high wind. Steps 8 shown in FIGS. 6A and 6C are those from PCT/2009/057138, which is herein incorporated by reference. They have curvature on the order of 1 cm radius (i.e. from about 0.3 cm to 3 cm) at the step and a reverse curvature on the order of 1 cm radius to the surface behind the step which at the end of the reverse curvature is about 0.6 cm above the step. In displacement mode, the water flow will approximately follow these two curvatures of the step, thereby giving drag which is smaller than a prior art step at speeds in transition mode and slow speeds in planing mode. As previously stated, front lift surface 7 and surface 71 give dynamic stability to the hull 99 in waves and chop while also allowing more of the front of the sailboard hull 99 to be in the water in displacement mode and in transition mode. The steps 8 reduce any undesirable downward force which is normally expected from a rockered surface while allowing the hydrostatic force in the water to turn the water smoothly back up to S2 where much more water is given downward momentum. At least at planing speeds in which S115 is substantially out of the water, most of the back of high lift surface 2 forms the end of the planing surface. The primary exception to this may be S15 which may also contribute to the total planing surface at such speeds.

As previously noted, S15 together with S2 give the watercraft hull dynamic stability in flat water. The center of lift/pressure is in front of the total center of gravity, CG, while most or all of S15 is in back of the CG. The total center of gravity is the hull when loaded; that is, the hull and sailor's combined center of gravity. The size of the sailboard hull 99 shown in FIGS. 6A-6C is smaller in width, namely 66 cm, than that for the hull 1 shown in FIGS. 5A-5C (which has a width of 80 cm), but both embodiments have roughly the same length. A narrower hull such as hull 99 is a board/hull which would normally be sailed in more wind and possibly at higher speeds where the wing 9 and slots 12 would be less important. Both of these sailboat embodiments can be used for a variety of widths and lengths.

Figure 6D:
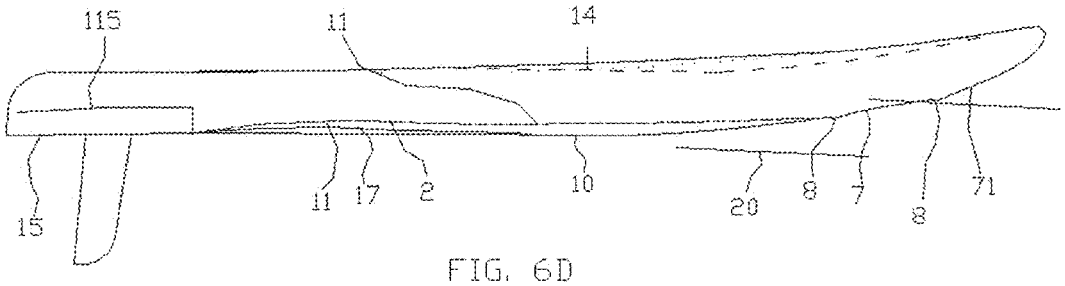
FIG. 6D shows a side view of yet another embodiment for a sailboard.
Figure 6E:
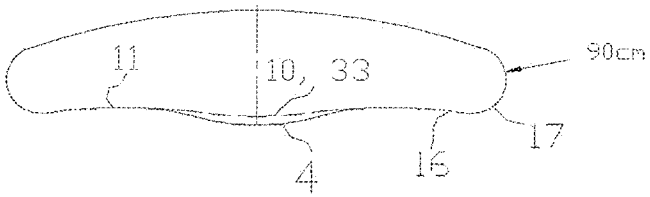
FIG. 6E shows a cross section from FIG. 6C taken at 90 cm from the back of the hull.

The camber 11 shown in FIG. 6D for the back 60% of high lift surface 2 is a three term Johnson camber with a value of 0.125 for Johnson's $C_{L,d}$. The front 40% of high lift surface 2 is a smooth very slight rocker in the longitudinal direction. The back roughly half of keel area 10 in FIG. 5A1 is shown as flat in the longitudinal direction. This keel area 10 along with back planing surface 15 can also be a three term Johnson camber as shown in FIGS. 6D and 5A3. This will give it greater lift to drag (i.e. efficiency) and will reduce the amount of transverse curvature between keel area 10 and the high lift surface 2. FIG. 6D shows the back roughly 60% of surfaces S10 and S15 with a value of 0.08 for the Johnson's $C_{L,d}$.

As a short summary thus far, an embodiment of this invention is a watercraft hull with a high lift surface 2, keel area 10, and back planing surface 15. S10 and S15 extend beyond the back of the high lift surface 2 for dynamic stability. These surfaces may have 3 and/or 5 term Johnson cambers or similar cambers (negative camber in the front and positive camber in the back). That is these two surfaces/area start with rockered lengths (negative camber) in the front then have more and more camber toward the rear of the given surface/area. The end of surface 2 can protrude deeper than the adjacent keel area 10, and back planing surface 15 may have edge rails, or transverse downward curvatures, of roughly the same depth as the end of high lift surface 2. Back planing surface 15 may also transition to other shapes such as a "V" shape and be double concave at its end. One exemplary camber is with the back roughly 30% designed for high speed planing (shorter length/higher aspect ratio) with the back roughly 60% of a 3 term Johnson camber with the reference line at about −2 to −3° blended in to the front roughly 70% of a 5 term Johnson camber design for slow planing speed (longer length/lower aspect ratio) with the reference line at zero degrees.

Surface 116 is a surface behind a step 117, similar to what is shown in PCT/2009/057138. Like surfaces S115, one or more surfaces 116 can provide lift at transition speeds and slow planing speeds. At higher planing speeds, however, surfaces 116 are generally mostly above the water flow beneath the sailboard 99. Surfaces 116 can also reduce wave drag at transition speeds by reducing the depth of the transom at the end of surfaces 116. From data collected on models of the embodiments for a sailboard hull as described herein, it appears that the cambered shape of a surface 115 gives more lift/drag than the shape of a surface 116. The hull in FIG. 6D has a small slot 12 under surface 115. The vertical line is the start of slot 12, not a prior art step.

Referring again to sailboard hull 99 as shown in FIGS. 6A-6C, at transition speeds and slow planing speeds the camber of high lift surface 2 provides about 40-50% more lift than a flat surface. The combination of a rocker/camber on high lift surface 2 results in a greater vertical component to the average force acting on S2, adding another roughly 25% to the total lift as compared to a flat surface. Due also to the reduced drag of S2, S15, and wings 9, the total lift/drag of an embodiment according to the invention is >150% of that of a similar sized sailboard with a rockered planing surface. (It is generally preferred that no appreciable rockered planing surface is present, since it tends to produce a suction force which reduces efficiency.) As a result, an embodiment such as that shown in FIGS. 5A-5C generally enters planing mode at about 20% less board speed as compared to a sailboard with a rockered planing surface. As there is furthermore a direct correlation between board speed and wind speed, this also results in planing mode being attainable at a minimum wind speed which is about 20% less than that required for the sailboard with a rockered planing surface. Experimental results, discussed below in relation in FIG. 7, show that minimum speeds required to achieve planing mode may be 30% or less than those required for known sailboards.

Again in reference to the sailboard shown in FIGS. 5A-5C, a winglet 9 may be to the back outside of high lift surface 2. That is to say, a winglet 9 may be provided at portions of S2 to either side of sailboard hull 1 and preferably predominantly aft of front lift surface 7. Above each winglet 9 is a slot 12, as shown in FIGS. 5A-5C, which provide at least three purposes. Slots 12

1) allow water flowing over winglet 9 to smoothly join water flowing under the sailboard at the back of winglet 9, thus reducing drag, 2) add some lift, and 3) allow water to flow more smoothly around the center of the hull 1.

The flow is thereby streamlined, which further minimizes drag. The thickness of a winglet 9 shown for sailboard hull 1 is on the order of 3.5% the chord length of the winglet. The slots 12 above wings 9 for a yacht hull 41 (shown in FIGS. 1A-1C) can also provide the same advantages identified above. However, the thickness of wing 9 for hull 41 is preferably on the order of 6% the chord length of the wing. Unless otherwise indicated, "on the order of" as used herein means a range which starts at a factor of 3.16 smaller than the given value (½ of an order of magnitude) to a factor of 3.16 larger than the given value. Thus, as an example, "on the order of 6" means a range of 2 to 19.

A high lift surface 2, as well as the top of a wing 9, may have some downward curve 16 in the transverse direction and then curve back to flat about 80-90% of the distance from the hull's midline to the edge. This feature is usable to help reduce the outflow of water while maintaining some rolling stability. While angling or curving the outer edges of the planing surfaces can increase the lift/drag efficiency, it can also increase the rolling instability. For sailboards, roll is controlled by a sailboarder, and thus this possible drawback is minimized. However, for yachts and power boats it is preferable to flatten and/or slightly round the rail similar to the rail in a slalom water ski. This reduces the lever arm of the elevated side verses the deeper side.

Surfaces S15 and S2 give the hull 41 dynamic longitudinal stability in flat water. The center of lift/pressure is near of the total center of mass, CG, while most or all of back planing surface 15 is in back of the CG.

Referring again to the sailboard hull embodiments of FIGS. 5A-5D and 6A to 6D, a keel area 10 as well as back planing surface 15 can have a three term and/or five term Johnson camber. This provides a greater lift to drag ratio and allows for a reduction in the amount of transverse curvature between keel area 10 and the high lift surface 2. The back roughly 60% of keel area 10 and planing surface 15 may have a three term Johnson camber with a value of 0.08 for the Johnson's $C_{L,d}$.

FIG. 7 shows a plot of drag vs. speed for a ½ scale model of a sailboard hull according to the invention (shown as Series 2 data). For comparison, Series 1 data is for a ½ scale model of a sailboard hull by the inventor made prior to the present invention. The Series 1 sailboard hull model had 12° downward curved sides and no cambered high lift surface. Both the Series 2 and Series 1 models were 125 cm long and 42 cm wide at the largest transverse size. As tested, the total weight of each model was 31 pounds.

It was unexpected that the drag for models made according to the present invention, including the model for the yacht or power boat which will be discussed below, would be so small considering how long people have been designing hulls for sailboards and planing powerboats. The Series 2 data from the model according to the invention show substantially superior hull performance as compared to the Series 1 data. To verify these results, the inventor retested two prior art models to obtain Series 3 and Series 4 data, respectively. As shown in FIG. 7, the prior art models performed comparable to the old model providing the Series 1 data. That is to say, the Series 2 data from the model according to the present invention considerably outperformed all three models reflecting older hull designs.

As shown in FIG. 7, the drag in series 2 is generally more than 40% less over speeds in the planing range and the lift/drag is more than 75% greater. Series 3 data was collected from a model with a square back which was flat in the transverse direction. Series 4 data was collected from a model which was narrower in the back with 10° downward curved sides in the transverse direction. It is readily apparent in FIG. 7 that the model according to the invention (Series 2) started planing mode at both lower drag and lower speed as compared to the other models (Series 1, 3, and 4). It is believed that the small rise in drag force near and over 20 mph in the Series 2 data is due to the center of lift of S2 moving behind the CG at higher planing speeds. It is preferred that the center of lift of S2 is near or in front of the CG, as discussed above. The greater lift to the back of the CG may result in an excessive downward force on front lift surface 7, possibly reducing the planing angle below the optimum.

Estimates from the Series 2 model according to the invention together with equations 2 and 3 above show that about 50% of the increased efficiency, and thus the lower minimum planing speed, may be due to the camber of high lift surface 2. Of the remaining improvement in efficiency, about 25% may be due to the negative camber (rocker) at the beginning of the high lift surface 2 which contributes to a larger vertical component to the lift vector over the cambered region, thereby reducing the dynamic drag. (Note that "vertical" refers to the directional axis corresponding to gravity.) The additional improvement in efficiency of the Series 2 model with respect to the Series 1, 3, and 4 models at high speed and possibly at all planing speeds may also be due to the keel area 10 extending past the high lift surface 2 in the Series 2 model. This extension in the tested model (Series 2) was 18% of the total length of the model's hull and accounted for approximately 20% of the high speed lift. Furthermore, no porpoising was seen in testing the Series 2 model, this effect being at least in part due to the extension of the keel region past the end of high lift surface 2.

During operation of a sailboard, a boarder moves backward on the board as speed increases, resulting in a shift of the CG toward the stern of the board. This effect on the CG of the hull-sailboarder combination was therefore accounted for in the experiment and reflected in the data shown in FIG. 7. The data shown for series 1, 2 and 4 was compiled according to test runs where the total center of gravity (CG) of each model was shifted longitudinally backward along the hull as a function of speed. (Note this was not done for Series 3.) That is to say, the higher the tested speed, the further back the CG was located on the model hull.

FIG. 8A shows a plot of drag/lift of a model for a yacht/power boat hull according to the invention (shown as Series 1 data). The model was 160 cm in length and 40 cm in width for Series 3 data and 148 cm×40 cm for Series 1 data. The total weight of the model when tested in series 1 was 38.5 pounds. In contrast to the sailboard models, the results of which are shown in FIG. 7, the yacht/power boat models for FIG. 8A had fixed centers of gravity (CGs). For full size actual yachts/power boats, the CG varies insignificantly with changing position of a sailor/operator(s) of the yacht/power boat.

Froude number, $F_\nabla$, is a dimensionless number. There are different formulas for calculating Froude numbers depending on the length, width, depth, and volume of displaced water of the one or more watercraft hulls being tested. For the present disclosure and experimental testing provided herein, the formula used is $$F_\nabla = v/(g\nabla^{1/3})^{1/2}, \quad (7)$$

where v is the velocity of the model or watercraft, ∇ is the volume of water displaced by the model or watercraft at rest, and 'g' is acceleration due to gravity. This formula is also what Clement uses (reference provided above). For the watercraft model of Series 1 in FIG. 8, the Froude number for a given velocity (based on volume of water displaced at rest) is 0.281 times the value of the speed (shown in mph). FIG. 8A shows that the Series 1 hull according to the invention had a $F_\nabla$ number of only 1.5 at the hump speed. This is notably much smaller than the normal $F_\nabla$ of roughly 2.1-2.3 for the prior art at hump speed. The reduced $F_\nabla$ of the model according to the invention demonstrates an advantage of the large amount of lift from a high lift surface 2 as taught herein. For comparison purposes, Series 2 in FIG. 8A shows experimental data for a "Deep-Vee with spray rails" configuration as given in FIG. 1-1 of the Clement reference identified above, the Clement figure being reproduced in FIG. 8B. As it is arranged to convey an understanding of the invention, no portion of FIG. 8B is admitted as being prior art to the current invention. It is worth noting that to adjust for the differences in sizes of the models used for Series 1 (current invention) and Series 2 (Clement Deep-Vee configuration), the data was adjusted by a factor of 1.83 to allow for their direct comparison. The factor of 1.83 was determined according to the difference in the Reynolds number of the respective models due to the different size and speed according to standard practice within the art. Series 3 data was collected for the same yacht hull model according to the present invention with surface 115 extended by 22 cm. The Series 3 model had the same features as the Series 1 model except for a longer surface 115 and a total weight of 57.7 lbs. From FIG. 8A it is shown that the Series 3 model, like the Series 1 model, has a $F_\nabla$ of approximately 1.5 at the hump speed. Both Series 1 and Series 3 show a very large reduction in drag compared to the data available from prior art. The planing efficiency (lift/drag) for both Series 1 and 3 gets as high as 7.1 and 7.6, respectively, as can be seen by the second y-axis in FIG. 8. (Note that the $2^{nd}$ y-axis is simply representative of an inverse of the primary y-axis showing drag/lift.) To convert from speed in mph to $F_l$ mentioned above, for a length of 160 cm, multiply the mph by 0.113.

FIG. 9 shows a plot of drag/lift for another model of a sailboard hull according to the invention. The Series 1 data is from a ½ scale model measuring 132 cm×41 cm with a total model weight of 28 lbs. Series 2 data is from a ½ scale model having identical features and characteristics as the Series 1 model except for: dimensions of 140 cm×41 cm, a total weight of 50 lbs, and S15 extending 7.5 cm further to the rear of the hull. At the hump speed, the Froude number is only 1.35. The maximum planing efficiency (lift/drag) attained by the Series 2 model was 8.3.

The same invention model was tested without the wing 9 and slots 12, from 3.9 mph to 13.5 mph. It appears that the drag was approximately 20% more at the transition or hump speed, but above 7 mph the drag was the same. Thus it is believed that for speeds above 3.9 mph (that is, above 4.4 mph for a full scale sailboard and above about 7 mph for a yacht), slots which are only at the back of the hull perform as well as slots extending at least the full length of the winglets. To represent this distinction, FIG. 5B shows slot length 123 only at the rear of the hull, and slot length 23 extending at least the full length of the winglets. FIG. 10 shows the results of a second yacht model built according to the embodiment of the invention shown in FIGS. 1A-1C, except without the super structure. The model was 160 cm in length and 40 cm at its widest cross-section. The total weight was 31 lbs. The data was collected in windy/wavy conditions with about 5 inch waves, which was approximately half the height of the model. The model was towed behind a jet ski (a Sea-Doo, WAKE 155, PWC) at a distance of 75 feet to minimize the effect of the jet ski's wake. As a basis for comparison, the Series 2 data of FIG. 10 is a reproduction of the Series 1 data from FIG. 8. The Series 1 model was designed with a more optimal shape for S115, i.e. more camber, and the plot in FIG. 10 shows almost an elimination of the hump in the drag vs. speed which traditionally occurs in transition mode of watercraft hulls. The depth of S115 at its end is 1.7 cm higher than S15 at the same longitudinal position, and the planing angle of S115 at its end is about 10 degrees. The Peak at 6.8 mph occurs at the start of the planing mode (see above at $F_l$=0.75).

The low drag at 10.5 mph shown in FIG. 10 occurred when the model was basically planing only on high lift surface 2. From 12 mph through 28 mph and higher the model is planing on both S2 and S7. At these speeds, the planing angle for known watercraft would normally be decreasing, the wetted surface increasing, and the drag increasing with speed. Instead, the Series 1 model according to the present invention shows the drag staying roughly constant from 12 to 18 mph. For a hull commonly intended to operate above 18 mph, $F_l$=2.0, the width of front lift surface 7 may simply be decreased as compared to the Series 1 model, as in the embodiment of FIGS. 2A-2C. The Series 1 model was accelerated through 33 mph for the data points taken at 24 and 28 mph. The Series 1 model showed no decrease in planing angle, $\alpha_0$, nor any increase in wetted surface area above about 12 mph. The increase in drag above 18 mph is most likely due to some of the water off of front lift surface 7 and step 8 reattaching behind high lift surface 2 on a flat surface rather than on the cambered surface. This is corrected by the embodiment in FIGS. 2A-2C. This can also be corrected, at least partially, by decreasing the planing angle at the end of front lift surface 7 and step 8, which in the tested model was 12 to 14 degrees.

The speed of 33 mph for the Series 1 model of FIG. 10 would be equivalent to 73 mph for a 30 ft long boat while 28 mph would be equivalent to 62 mph and the drag/lift would be reduced to 0.143. For the embodiment shown in FIGS. 2A-2C, the drag/lift should be near 0.1 or 0.11.

Although other boat configurations like Clement's Dynaplane, three point hydrofoils, and tunnel boats may have efficiencies similar to those of the present invention at very fast planing speeds, e.g. 60 to 100 mph, no non-foil based configurations are known to the inventor which have:

1) such comparatively small drag at transition speed, 2) such comparatively small drag at low planing speed, or 3) such a comparatively large planing range with a low minimum planing speed threshold, as compared to the present invention.

Figure 12A:
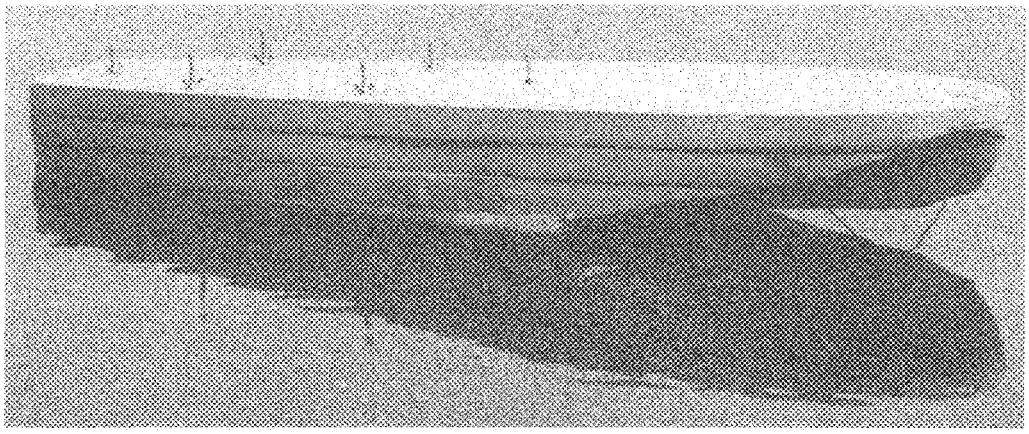
FIGS. 12A and 12B show, respectively, a bottom and side view of a model of an embodiment shown in FIGS. 1A-1C for a yacht hull.
Figure 12B:
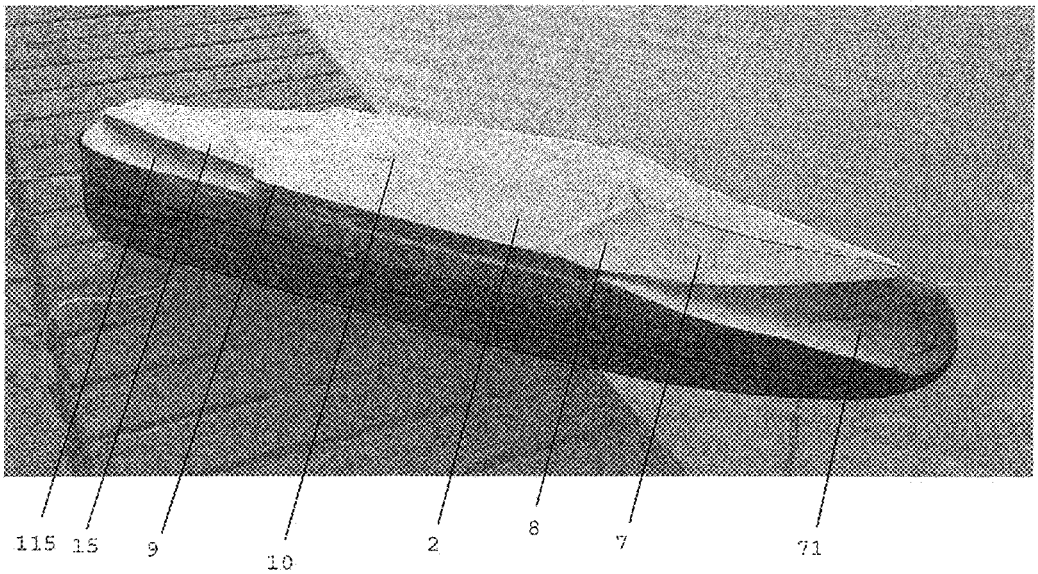

FIGS. 12A and 12B show a physical yacht hull model according to the invention. This model corresponds with the embodiment shown in FIGS. 1A-1C. FIG. 12A shows the top of the model floating in water as tested. At rest, surface 7 at step 8 is about 1 cm deep in the water. FIG. 12B shows the model flipped over and out of the water so as to show the bottom and side. On the bottom of the model hull S71, S7, step 8, groove 82, S2, and S15 are all clearly visible from bow to stern. On the side winglet 9 with slot 12 and S115 are all apparent as seen from the middle to the stern of the hull. Cambers are visible on all surfaces S7, S2, S15, and S115, corresponding with the teachings herein.

From the bottom view in FIG. 12B one can see that the model is streamlined. For flat and rockered planing surfaces, as in prior art, the large area of such planing surfaces is one of the most important parameters for lift. This generally results in a streamlined hull not being possible. In contrast, the cambered surfaces, in particular cambered high lift surface 2, of the present invention overcome this limitation of prior watercrafts hulls, allowing for a streamlined hull.

From the knowledge of building and testing these embodiments, it is preferred that the position of the widest part of the hull be at the start of the camber of the high lift surface 2 (that is, the intersection or line between the rockered part and the cambered part) + or −15% of the hull length. This is behind the widest part shown in FIGS. 1A-5C. It is where the dynamic force vector would be either the most vertical or pointed slightly forward and where the dynamic drag component of this vector would be the smallest or negative. It also increases the aspect ratio of the high speed wetted area of S2 and/or makes the hull narrower and more streamlined.

In summary, one or more of the following advantages may be attainable according to the invention:

a) A hull with less drag resistance when planing and 75% or greater lift to drag ratio (i.e. efficiency);

b) A hull which is dynamically stable, i.e. no porpoising, and generally has stability against normal waves and chop; and c) A hull with a wider planing speed range with low drag force.

Figure 11A:
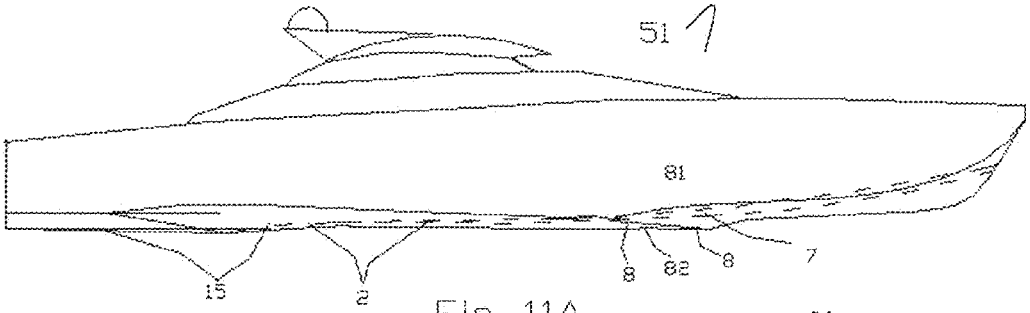
FIGS. 11A and 11B show, respectively, a side view and bottom view of a Trimaran according to the invention.
Figure 11B:
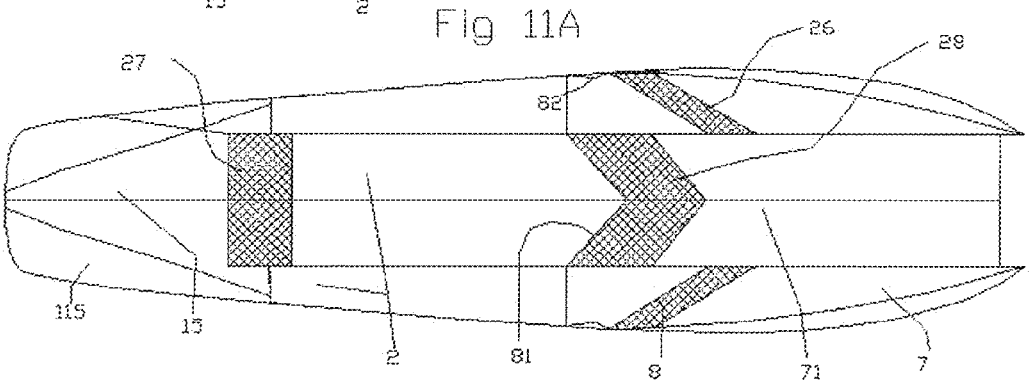

Although the experimental data shown in FIGS. 7-10 are drawn to embodiments for mono-hull watercraft, the invention may also be practiced with, for example, a trimaran such as that which is shown in FIGS. 11A and 11B. However, experimental data for a trimaran according to the invention is not yet available.

Although the invention has been described predominantly in reference to sailboards and yachts/power boats, those skilled in the art will understand and recognize that this invention can be applied to other watercraft including, for example, stand up paddle (SUP) boards, sailboards designed for speed, surfboards, catamarans, and trimarans. It may also be used in combination with other inventions and technologies such as wave piercing planing hulls like P. R. Payne, U.S. Pat. No. 3,763,810, and E. P. April, U.S. Pat. No. 4,649,851, in accordance with the teachings herein.

Thus the scope of the invention should be determined by the appended claims and their legal equivalents rather than by the examples given. The abstract is given with the understanding that it will not be used to interpret or limit the scope or meaning of the claims.

What I claim is:

1. A hull for a watercraft having a length and a maximum width, comprising:

a rockered keel area;

a front lift surface;

a back planing surface, wherein at least one portion of either or both said front lift surface and said back planing surface has positive camber in a longitudinal direction; and a main lift surface adjacent said rockered keel area and between said front lift surface and said back planing surface with a longitudinal position such that a center of dynamic lift of said main lift surface is at or in front of a point which is a fraction of said length of said hull behind a total center of gravity of said hull, wherein at least a back portion of said main lift surface has positive camber in the longitudinal direction, and a beam at said main lift surface is greater than two thirds said maximum width, wherein said front lift surface and said main lift surface are separated by a step in one or more of hull depth and attack angle, wherein said back planing surface is longitudinally separated from at least a portion of said main lift surface ending in a step in one or more of hull depth and attack angle, wherein the front lift surface supports less than 50% of the hull's total planing lift, and wherein a line running along the hull surface along the hull centerline from the front of said front lift surface to the middle of said main lift surface to the back of the back planing surface will have rocker or zero camber.

2. The hull as recited in claim 1, wherein said fraction is 15% of said length of said hull.

3. The hull as recited in claim 1, wherein said at least one portion of either or both said front lift surface and said back planing surface is positively cambered with a 3 term Johnson camber, a 5 term Johnson camber, or a combination thereof.

4. The hull as recited in claim 1, wherein said main lift surface is positively cambered in the back and rockered in the front.

5. The hull as recited in claim 1, wherein said maximum width and a front edge of said at least a back portion of said main lift surface are at the same longitudinal position plus or minus 15% said length of said hull.

6. The hull as recited in claim 1, further comprising a second back planing surface at least to either side of first said back planing surface, said second back planing surface having a displacement from said first back planing surface in a vertical direction.

7. The hull as recited in claim 1, wherein at least a back 20% of said main lift surface has a larger average angle with respect to the longitudinal direction than adjacent rockered keel area.

8. The hull as recited in claim 1, wherein said back planing surface is an extension of said rockered keel area or said main lift surface.

9. The hull as recited in claim 1, further comprising a pair of wings or winglets; and a slot in the side of said hull above at least a portion of each wing or winglet of said pair of wings or winglets, said slot extending behind of, in front of, or both behind and in front of said each wing or winglet, wherein said main lift surface includes bottoms of said pair of wings or winglets, and wherein said slot has a height less than a length of said wings or winglets.

10. The hull as recited in claim 1, wherein said main lift surface has a downward angle from the deadrise angle near the keel for at least 60% of a transverse distance from a hull centerline to a hull edge and an upward angle forming a flat or soft rail at said hull edge.

11. The hull as recited in claim 1, further comprising a second front lift surface vertically displaced from first said front lift surface.

12. The hull as recited in claim 11, wherein said front lift surface and said second front lift surface together have one or more steps.

13. The hull as recited in claim 12, wherein at least one of said one or more steps has a radius of curvature of 0.3-3 cm times a factor substantially equaling said length of said hull in centimeters divided by 230 cm.

14. The hull as recited in claim 1, wherein said front lift surface terminates in a step, said front lift surface and said step dewetting at least a longitudinal center portion or a longitudinal outer portion of said main lift surface in planing mode, wherein said step, the two dimensional lift coefficient $C_{LD}$, and the attack angle of said front lift surface are configured such that water coming off said step reattaches on said main lift surface or said back lift surface.

15. A hull for a watercraft having a length and a maximum width, comprising:

a rockered keel area;

a first front lift surface, wherein said front lift surface terminates in a first step;

a second front lift surface vertically displaced from said first front lift surface;

a back planing surface, wherein at least one portion of either or both said first front lift surface and said back planing surface has positive camber;

a main lift surface adjacent said rockered keel area and between said first front lift surface and said back planing surface with a longitudinal position such that a center of dynamic lift of said main lift surface is at or in front of a point which is a fraction of said length of said hull behind a total center of gravity of said hull, wherein at least a back one third of said main lift surface has positive camber, and a beam at said main lift surface is greater than two thirds said maximum width; and at least one second step transversely next to said first step, wherein said first step is configured to dewet at least a longitudinal center portion or a longitudinal outer portion of said main lift surface in planing mode, and wherein said at least one second step has a smaller planing attack angle than said first step such that in planing mode said at least one second step dewets part of a remaining longitudinal portion of said main lift surface which is behind said second step.

16. The hull as recited in claim 1, wherein said high main lift surface forms at least ⅔ of the wetted area of a planing underside of said hull.

17. The hull as recited in claim 1, further comprising one or more hydraulic trim tabs behind one or both of said main lift surface and said back planing surface for adjusting the trim angle.

18. The hull as recited in claim 1, wherein said hull is a monohull.

19. A hull for a watercraft, comprising:

a front lift surface, a back portion of said front lift surface having positive camber being cambered;

a main lift surface behind said front lift surface, said main lift surface being positively cambered in the back and rockered in the front; and a back planing surface behind said main lift surface configured such that a center of lift of said main lift surface is in front a point which is 15% of the hull length behind a total center of gravity of said hull, wherein said front lift surface terminates in one or more steps in one or more of hull depth and attack angle, said one or more steps being configured to dewet at least a longitudinal portion of said main lift surface in planing mode, wherein said back planing surface is longitudinally separated from at least a portion of said main lift surface ending in a step in one or more of hull depth and attack angle, wherein the front lift surface supports less than 50% of the hull's total planing lift, and wherein a line running along the hull surface along the hull centerline from the front of said front lift surface to the middle of said main lift surface to the back of the back planing surface will have rocker or zero camber.

20. The hull as recited in claim 19, wherein at least two of said front lift surface, main lift surface, and back planing surface are positively cambered in the back and rockered in the front.

21. The hull as recited in claim 19, further comprising one or more additional surfaces which are positively cambered in the back and rockered in the front.

22. The hull as recited in claim 1, wherein the back planing surface and the front lift surface together with the main lift surface control the planing attack angle of the hull.

* * * * *